US006094850A

United States Patent [19]

Villani

[11] Patent Number: 6,094,850

[45] **Date of Patent: *Aug. 1, 2000**

[54] AUTOMATIC CARTRIDGE MONITORING AND INDICATOR SYSTEM FOR A FIREARM

[76] Inventor: Michael J. Villani, P.O. Box 2144, Centerville, Mass. 02632

[ * ] Notice: This patent issued on a continued prosecution application filed under 37 CFR 1.53(d), and is subject to the twenty year patent term provisions of 35 U.S.C. 154(a)(2).

[21] Appl. No.: 08/652,974

[22] Filed: May 24, 1996

Related U.S. Application Data

[63] Continuation-in-part of application No. 08/266,943, Jun. 27, 1994, Pat. No. 5,592,769.

[51] Int. Cl.[7] ..... F41A 9/62

[52] U.S. Cl. ..... 42/1.02; 42/49.01

[58] Field of Search ..... 42/1.01–1.05, 42/70.02, 50

[56] References Cited

U.S. PATENT DOCUMENTS

| | | | |
|---|---|---|---|
| 657,918 | 9/1900 | Copping et al. | 42/1.01 |
| 1,252,094 | 1/1918 | De Lempdes | 42/1.02 |
| 1,653,698 | 12/1927 | Coupland | 42/1.01 |
| 2,377,661 | 6/1945 | Baker et al. | 42/50 |
| 2,828,568 | 4/1958 | Sakewitz | 42/1.02 |
| 3,229,399 | 1/1966 | Harvey | 42/1.01 |
| 3,552,053 | 1/1971 | Jarvis | 42/1.03 |
| 4,001,961 | 1/1977 | Johnson et al. | 42/1.05 |
| 4,142,313 | 3/1979 | Musgrave | 42/40 |
| 4,216,601 | 8/1980 | Musgrave | 42/1.05 |
| 4,219,953 | 9/1980 | Musgrave | 42/1.05 |
| 4,296,564 | 10/1981 | Oberst | 42/50 |
| 4,541,191 | 9/1985 | Morris et al. | 42/1.01 |
| 4,558,626 | 12/1985 | Bartolles | 89/24 |
| 4,587,756 | 5/1986 | Jakubaschik et al. | 42/50 |
| 4,692,014 | 9/1987 | Kiuchi | 354/471 |
| 4,754,296 | 6/1988 | Neely | 354/195.13 |
| 4,793,085 | 12/1988 | Surawski et al. | 42/84 |
| 5,005,307 | 4/1991 | Horne et al. | 42/1.02 |
| 5,016,378 | 5/1991 | Sain | 42/70.06 |
| 5,052,138 | 10/1991 | Crain | 42/1.02 |
| 5,113,605 | 5/1992 | Kim | 42/50 |
| 5,142,805 | 9/1992 | Horne et al. | 42/1.02 |
| 5,303,495 | 4/1994 | Harthcock | 42/84 |
| 5,406,730 | 4/1995 | Sayre | 42/1.02 |
| 5,557,872 | 9/1996 | Langner | 42/1.03 |
| 5,566,486 | 10/1996 | Brinkley | 42/1.02 |
| 5,642,581 | 7/1997 | Herold et al. | 42/1.02 |
| 5,735,070 | 4/1998 | Vasquez et al. | 42/1.02 |

FOREIGN PATENT DOCUMENTS

0549288A2 6/1993 European Pat. Off. .

OTHER PUBLICATIONS

Advertisement, B–Square Competition Mounts, Tactell Inc., undated.

Advertisement, Tactell Ammo Indicators, Tactell, Inc., undated.

Tasco Propoint, Tasco Sales, Inc., 1993.

Law 2000, Aro–Tek, Ltd., 1993.

*Primary Examiner*—Charles T. Jordan
*Assistant Examiner*—Christopher K. Montgomery
*Attorney, Agent, or Firm*—Iandiorio & Teska

[57] ABSTRACT

An automatic cartridge monitoring and indicator system for a firearm having a magazine and a chamber for monitoring the level of a predetermined number of cartridges in the magazine and in the chamber includes: a magazine for storing at least the predetermined number of cartridges; a follower mechanism for feeding the cartridges from the magazine into the chamber; an actuator moveable with the follower mechanism; a monitoring device disposed along the path of the follower mechanism; the monitoring device including a number of magazine switch elements corresponding to the predetermined number of cartridges in the magazine and an additional chamber switch element corresponding to a cartridge in the chamber; the switch elements are operable by the actuator to monitor the level of cartridges in the magazine and chamber; and an indicator device, responsive to the monitoring device, for providing a representation of the level of cartridges in the magazine and in the chamber.

33 Claims, 22 Drawing Sheets

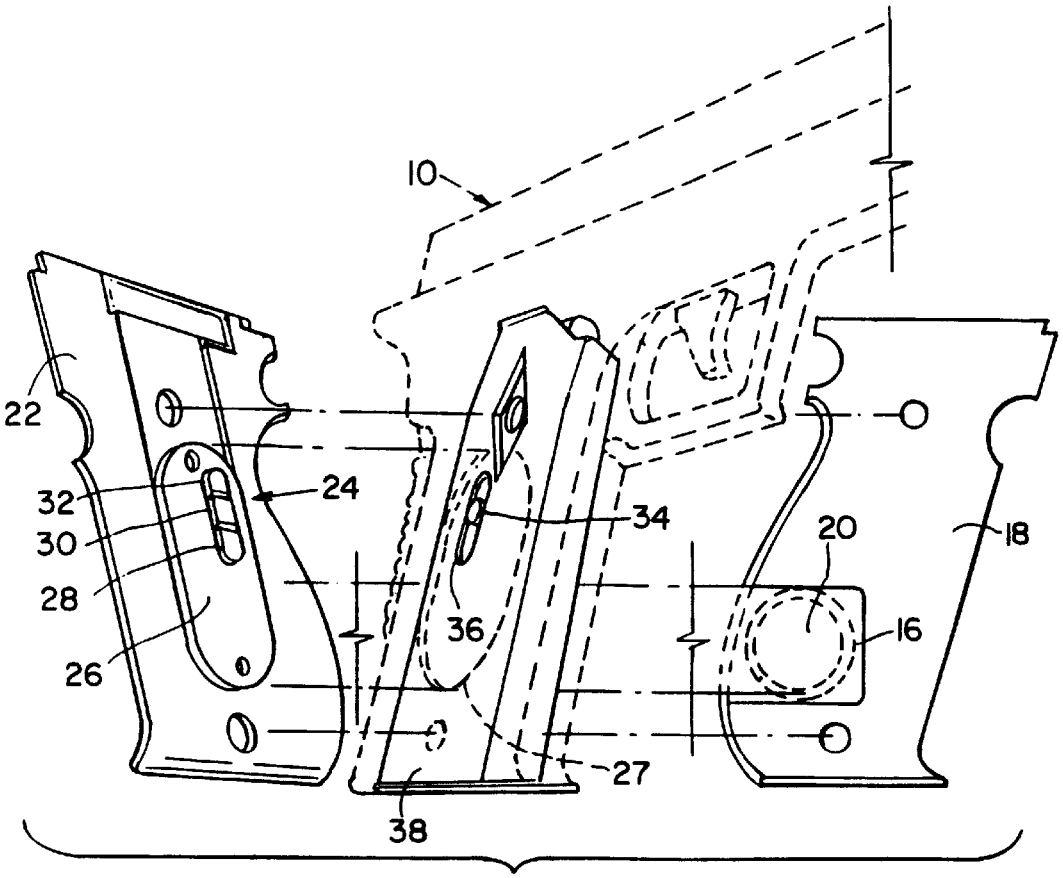
FIG. 6
FIG. 7
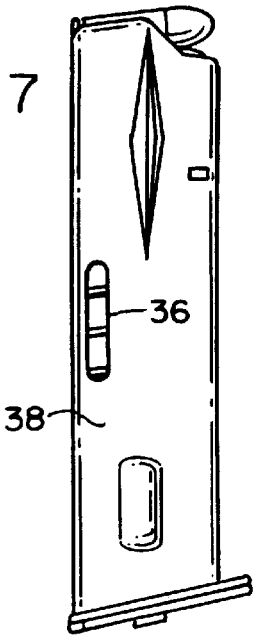
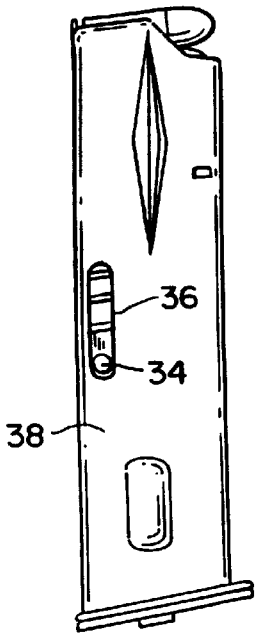
FIG. 8

FIG. 45
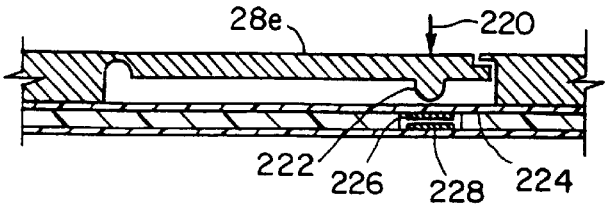
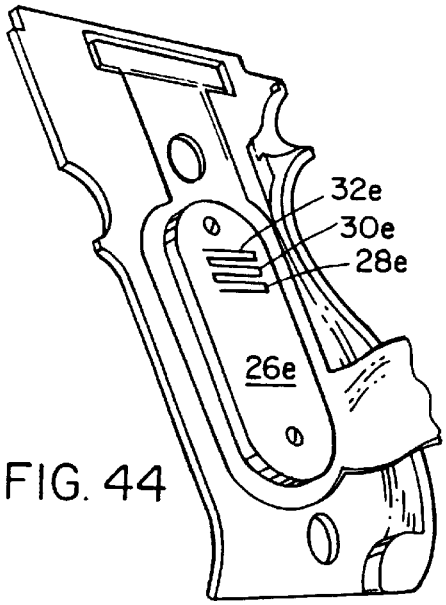
FIG. 44
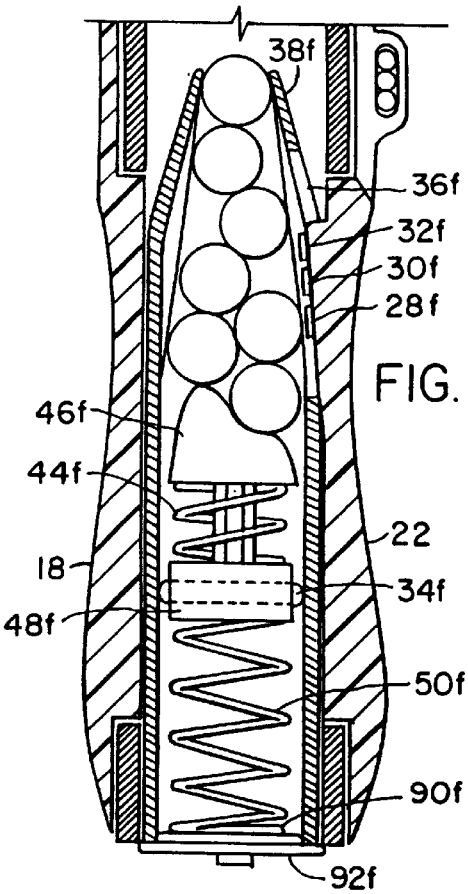
FIG. 46
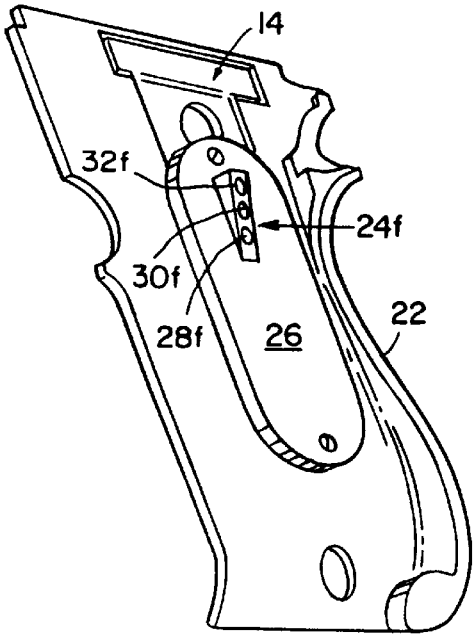
FIG. 47
FIG. 48
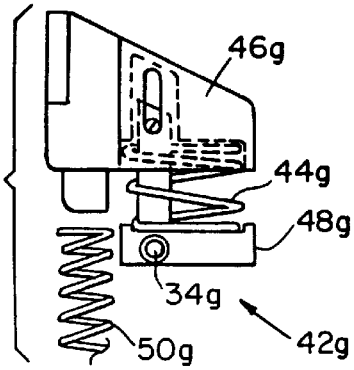

AUTOMATIC CARTRIDGE MONITORING AND INDICATOR SYSTEM FOR A FIREARM

RELATED CASE

This application is a continuation-in-part of application Ser. No. 08/266,943 filed Jun. 27, 1994, "Automatic Cartridge Monitoring and Indicator System for a Firearm" by Michael J. Villani now U.S. Pat. No. 5,592,769 issued Jan. 14, 1997.

FIELD OF INVENTION

This invention relates to an automatic cartridge monitoring and indicator system for a firearm and more particularly to one which cumulatively monitors the level of cartridges in both the magazine and in the firing chamber.

BACKGROUND OF INVENTION

When firing semi-automatic and automatic firearms in law enforcement, military actions and in target shooting competition it is desirable to know when the magazine is about to run out of ammunition. Competition shooters need to know this information so they can be prepared to release the empty magazine and replace it with a full one with minimum loss of shooting time. In police and military operations the need to know is far more serious. Police officers and soldiers can lose their lives in the split second it takes to realize a magazine must be replaced, or an enemy or felon can escape in that time. And studies have shown that under the stress of a firefight it is nearly impossible for the user to keep accurate track of the cartridges fired and those remaining. Prior attempts to monitor the number of cartridges in a magazine by indicating the number expended or the number remaining have met with indifferent success, and by and large applied generally only to pistols and not other firearms. The apparatus often was large and cumbersome and required modifications to each firearm for retrofitting or required redesign for installation with original equipment manufacturers. Such systems did not distinguish between an empty condition and a jammed condition. There were often on-off switches: a real drawback when the user forgets to turn on the system. The prior art designs often relied solely on displaying a count of the number of cartridges spent or remaining, which meant that the shooter had constantly to be watching the display: there was no alarm that communicated urgency. And the brightness of the display was fixed and not adaptable to ambient light conditions or shooters with poorer eyesight. Often the display used an LCD which is not visible in dark or low light conditions, a serious problem in many law enforcement situations. Typically there was no way to test the battery or other power supply or the display to see that the monitoring system was working. The known systems also impeded the free-fall of a released magazine and were not waterproof, a serious shortcoming in police and military applications. And the addition of the monitoring system to the firearm often interfered seriously with the critical ergonomics of the firearm.

In one prior art system, disclosed in U.S. Pat. No. 5,303,495 to Harthcock, only the number of cartridges in the magazine of the weapon are taken into account. As shown in FIG. 1 of that patent there are eight Hall effect switches corresponding to eight cartridges within the magazine. As a spring moves up within the magazine when each cartridge is loaded into the firing chamber a magnet on the spring is moved into proximity with a different switch. The magnet activates the switch and the system provides an indication of the number of cartridges remaining in the magazine.

However, this system does not account for the cartridge in the firing chamber. Therefore, any count displayed by that system is ambiguous. It could indicate that the number of cartridges in the magazine is the total number of cartridges in the firearm, but only when no cartridge is actually in the firing chamber. With the same reading, there could be an additional cartridge in the firing chamber not indicated on the display. The only way the user will know for sure is to check the firing chamber. This is obviously unacceptable under most circumstances, such as in a firefight.

In another prior art system, disclosed in U.S. Pat. No. 5,052,138 to Crain, the follower in the magazine engages contact strips on the interior walls of the magazine to provide a count of the number of cartridges in the magazine. A separate external sensor to monitor the reciprocal movement of the slide of the weapon to account for the cartridge in the chamber must be provided. That system is mechanically complex and requires significant modification of an existing weapon or the user must purchase a weapon manufactured to include the separate external sensor. Moreover, the weapon must also be equipped with complicated circuitry to combine the signal from the external sensor and the signal from the contact strips to indicate the cartridge count in the weapon.

In yet another prior art system, disclosed in U.S. Pat. No. 5,142,805 to Horne et al., when a magazine, ordinarily containing for example eight cartridges, is inserted into the firearm, a microcontroller sets the number of cartridges to eight and displays this number on an LCD. When the firearm slide moves rearwardly upon firing of the firearm or upon manual retraction of the slide, the cartridge count is decremented by one. This system therefore, only operates properly when a fully loaded magazine with a predetermined number of cartridges is loaded into the firearm. This system cannot give an accurate count of cartridges in the firearm when a partially depleted magazine is inserted unless the microcontroller is manually re-programmed with the number of cartridges in the partially depleted magazine. This system is therefore not very useful, especially given the fact that it is standard combat operating procedure to eject a partially depleted magazine to ensure that the firearm never becomes unexpectedly empty and then to later reload the partially depleted magazine. Moreover, if, due to human error, a magazine which is not fully loaded is inserted into the firearm the Horne et al. system will not provide an accurate cartridge count.

SUMMARY OF INVENTION

It is therefore an object of this invention to provide an improved automatic cartridge monitoring and indicator system for a firearm.

It is a further object of this invention to provide such an improved automatic cartridge monitoring and indicator system for a firearm which provides a clear, unambiguous indication of the number of cartridges in both the magazine and firing chamber of a firearm.

It is a further object of this invention to provide such an automatic cartridge monitoring and indicator system for a firearm which has a very simple and efficient yet ingenious design for providing an indication of the number of cartridges in the firearm.

It is a further object of this invention to provide such an automatic cartridge monitoring and indicator system for a firearm which provides an indication of the number of cartridges in the firearm without requiring an external sensor to sense the movement of the slider of the firearm.

It is a further object of this invention to provide such an automatic cartridge monitoring and indicator system which is not limited only to pistols.

It is a further object of this invention to provide such an automatic cartridge monitoring and indicator system for a firearm which is small and compact and can be electrical or mechanical.

It is a further object of this invention to provide such an automatic cartridge monitoring and indicator system for a firearm which can be totally housed within the handle grips and magazine and requires no modification to the firearm.

It is a further object of this invention to provide such an automatic cartridge monitoring and indicator system for a firearm which is easily retrofitted to existing firearms or added to new firearms.

It is a further object of this invention to provide such an automatic cartridge monitoring and indicator system for a firearm which distinguishes between an empty condition and a jammed condition.

It is a further object of this invention to provide such an automatic cartridge monitoring and indicator system for a firearm which is energized without an on-off switch but could have an on-off switch if desired.

It is a further object of this invention to provide such an automatic cartridge monitoring and indicator system for a firearm which can use alarm lights.

It is a further object of this invention to provide such an automatic cartridge monitoring and indicator system for a firearm which when using a visual light display as an indicator of cartridge level, i.e., cartridges spent or remaining, permits for adjustment of the display brightness either manually or automatically in response to ambient light conditions.

It is a further object of this invention to provide such an automatic cartridge monitoring and indicator system for a firearm which is easily tested to determine whether or not the power supply and indicator system are working.

It is a further object of this invention to provide such an automatic cartridge monitoring and indicator system for a firearm in which the magazine quickly and easily is removed in free-fall upon release.

It is a further object of this invention to provide such an automatic cartridge monitoring and indicator system for a firearm which can be waterproof for police and military applications.

It is a further object of this invention to provide such an automatic cartridge monitoring and indicator system for a firearm which preserves the critical ergonomics of the firearm.

It is a further object of this invention to provide such an automatic cartridge monitoring and indicator system for a firearm which enables the indicator portion of the system to be located on the firearm.

This invention results from the realization that an automatic cartridge monitoring and indicator system for a firearm which provides an accurate and reliable indication of the level of cartridges in both the magazine and firing chamber of the firearm having a very simple and efficient design can be achieved by providing a monitoring device disposed along the path of the firearm's follower mechanism including a number of magazine switch elements corresponding to a predetermined number of cartridges in the magazine and an additional chamber switch element corresponding to the one cartridge within the chamber, wherein the switch elements are operable by an actuator on the follower mechanism to monitor the level of cartridges in the magazine and in the chamber.

This invention features an automatic cartridge monitoring and indicator system for a firearm having a magazine and a chamber for monitoring the level of a predetermined number of cartridges in the magazine and in the chamber. There is included a magazine for storing at least the predetermined number of cartridges and a follower mechanism for feeding the cartridges from the magazine into the chamber. There is an actuator moveable with the follower mechanism and a monitoring device disposed along the path of the follower mechanism. The monitoring device includes a number of magazine switch elements corresponding to the predetermined number of cartridges in the magazine and an additional chamber switch element corresponding to a cartridge in the chamber. The switch elements are operable by the actuator to monitor the level of cartridges in the magazine and chamber. There is also included an indicator device, responsive to the monitoring device, for providing a representation of the level of cartridges in the magazine and in the chamber.

In a preferred embodiment the switch elements may be mounted on the firearm. The magazine may be a box magazine. The actuator may protrude through an aperture from the magazine to engage the switch elements. The magazine may include a aperture and the switch elements may protrude into the magazine to engage the actuator. The indicator device may provide a representation of the total number of cartridges remaining in the magazine and the chamber of the firearm. The indicator device may provide a representation that the last cartridge is in the chamber and the magazine is empty. The indicator device may provide a representation of the number of cartridges expended from the magazine and of a malfunction. The representation provided by the indicator device may include a visual display. The visual display may include at least one light. The visual display may include an alphanumeric readout. The follower mechanism may include a follower element and a spring device for urging the follower element to feed the cartridges to the firearm. The follower mechanism may include a follower element, an intermediate element spaced from the follower element, a first spring device between the elements and a second spring device engaged with the side of the intermediate element opposite the first spring device. The first spring device may open before the second spring device and remain open while the second spring device opens. The follower mechanism may include a limiter device interconnecting the elements to define the distance by which the elements can be separated by the first spring device. The actuator may be mounted for movement with the intermediate element. The actuator may be mounted for movement with the follower element. The second spring device may include two spring sections, an upper and a lower section, the upper section being smaller in diameter than the lower section.

The firearm may include handle grips and at least one of the grips may include a housing for holding at least a portion of the monitoring device. The monitoring device may include a power source and the power source may be in the housing. The power source may include a battery. The indicator device may be mounted on the firearm. The firearm may include handle grips and the indicator device may be fixed to one of the grips. The light may be energized when there is but one cartridge remaining in the chamber of the firearm.

The visual display may include two lights, the first of which is energized when there is one cartridge left in the chamber of the firearm and the second of which is energized when there is one cartridge in the chamber and one cartridge left in the magazine. The first light may be red and the second light may be yellow. The visual display may include three lights, the first of which is energized when there is one cartridge left in the chamber of the firearm, the second of which is energized when there is one cartridge in the chamber and one cartridge left in the magazine, and the third of which is energized when there is one cartridge in the chamber and two cartridges left in the magazine. The first light may be red, the second light may be yellow, and the third light may be green. The first light may remain energized after the last cartridge has been fired. The monitoring device may be always be enabled and operate automatically upon the level of cartridges reaching a predetermined level.

The monitoring device may include a test switch for energizing the indicator device and demonstrate its operability. The monitoring device may include an adjustment device for setting the brightness of the at least one light. Ambient light levels may be sensed and the brightness of the one light may be set as a function of the ambient light. The at least one light may include an LED. The switch elements may include associated operator elements responsive to the actuator for operating the switch elements. The switch elements may include membrane switches and the firearm may have include an aperture for permitting the actuator to engage the membrane switches. The firearm may have handle grips and the membrane switches may be mounted in an internal recess in one of the grips. The operator elements may be mounted on the inside of the grip and extend through an aperture in the handle of the firearm. The firearm may include handle grips, the monitoring device may include a power source in one of the grips and the switching elements in the other of the grips, and the power source and switching elements may be electrically interconnected by a first flat ribbon conductor disposed within the existing grips. The power source may be housed within a second flat ribbon conductor interconnected with the first flat ribbon conductor.

The indicator device may be contained in a mounting box and one of the grips may include a recess for receiving the mounting box. The mounting box may be sized for an interference fit with the recess. The switch elements may include membrane switches. The actuator may be spring loaded and the firearm may include handle grips, and one of the handle grips may include a recess for accommodating extension of the actuator protruding from the magazine for permitting the magazine to move freely in the firearm and a camming surface at the end of the recess for gradually compressing the actuator to facilitate removal of magazine from the firearm. The actuator may have an actuator element extending from each side of the magazine.

The monitoring device may include the switch elements associated with each side of the magazine for operation by an associated one of the actuator elements. The actuator elements may be spring loaded and the firearm may include two handle grips, each of which handle grips may include a recess for accommodating extension of the associated actuator element protruding from the magazine for permitting the magazine to move freely, centrally longitudinally in the firearm, and a camming surface at the end of each recess for gradually compressing the actuator elements to facilitate removal of the magazine from the firearm. Each switch element may include a pair of spaced conductors, and the actuator may include a conductive contact for bridging the spaced conductors and electrically connecting them to actuate the indicator device. The battery may be mounted internally on a handle grip and it may extend into an aperture existing on the firearm frame. The firearm may include handle grips, the monitoring device may include a power source in one of the grips and the switch elements in the other of the grips, and the power source and the switch elements may be electrically interconnected by conductors in each of the grips and connection pins in one grip that engage sockets in the other.

There may further be included a remote data connector responsive to the monitoring device for providing a representation of the condition of the firearm to a remote device. The actuator may include a spring-loaded actuator element and the actuator element may include a cam surface to guide it back into the magazine to facilitate easy loading of cartridges into the magazine. The follower mechanism may include a follower element and an intermediate element spaced from the follower element, a first spring device between the elements and a second spring device engaged with the side of the follower element facing the intermediate element. The firearm may include a magazine release mechanism, the switch elements may be biased to enter an aperture in the magazine to engage the actuator, and the switch elements may include an interconnection device responsive to the release mechanism for overcoming the bias and retracting the switch elements from the magazine aperture simultaneously with the operation of the release enable the magazine to freely fall from the firearm. The magazine and switch elements may be in the frame of the firearm. The firearm may be a pistol. The magazine may be mounted in a magazine receiver and the switch elements may be mounted on the outside of the receiver through an aperture. The firearm may be a rifle. The follower mechanism may include two interconnected sections movable relative to each other, the actuator may include at least one actuator element on at least one of the sections of the biasing means urging apart the sections and urging the actuator element to engage the switching device. The firearm may include two handle grips which are integrally formed as a single unit. The magazine may be a tubular magazine.

DISCLOSURE OF PREFERRED EMBODIMENT

Other objects, features and advantages will occur to those skilled in the art from the following description of a preferred embodiment and the accompanying drawings, in which:

FIG. 6 is a view of the firearm of FIG. 1 shown in phantom with the handle grips exploded out, revealing the battery compartment, switching device and actuator in the magazine;

FIG. 7 is a side elevational view of a magazine adapted in accordance with this invention usable in the firearm of FIG. 1 before the actuator becomes visible;

FIG. 8 is a view similar to FIG. 7 after the actuator has become visible;

FIG. 18 is a view similar to FIG. 16 after the last round has been fired, the slide is back, and the red light remains on;

FIG. 44 is a three-dimensional view of a handle grip with an alternative switching device according to this invention;

FIG. 45 is a side elevational view of one of the switch elements of FIG. 44;

FIG. 46 is an elevational sectional view of a portion of the handle of a firearm with the switching device protruding into the magazine;

FIG. 47 is a three-dimensional view of the handle grip of the firearm with the switching device with the protruding switches of FIG. 46;

FIG. 48 is a side elevational view of another follower mechanism according to this invention;

Figure 68:
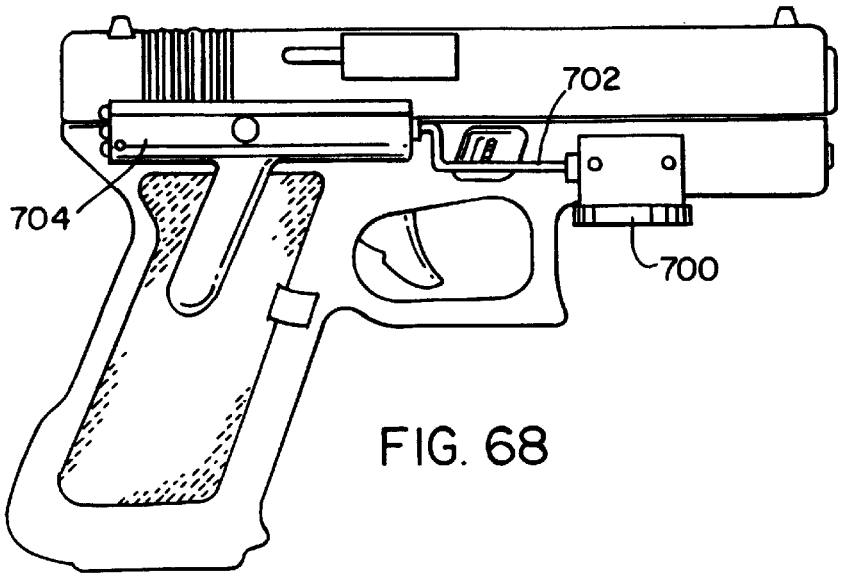
Figure 69:
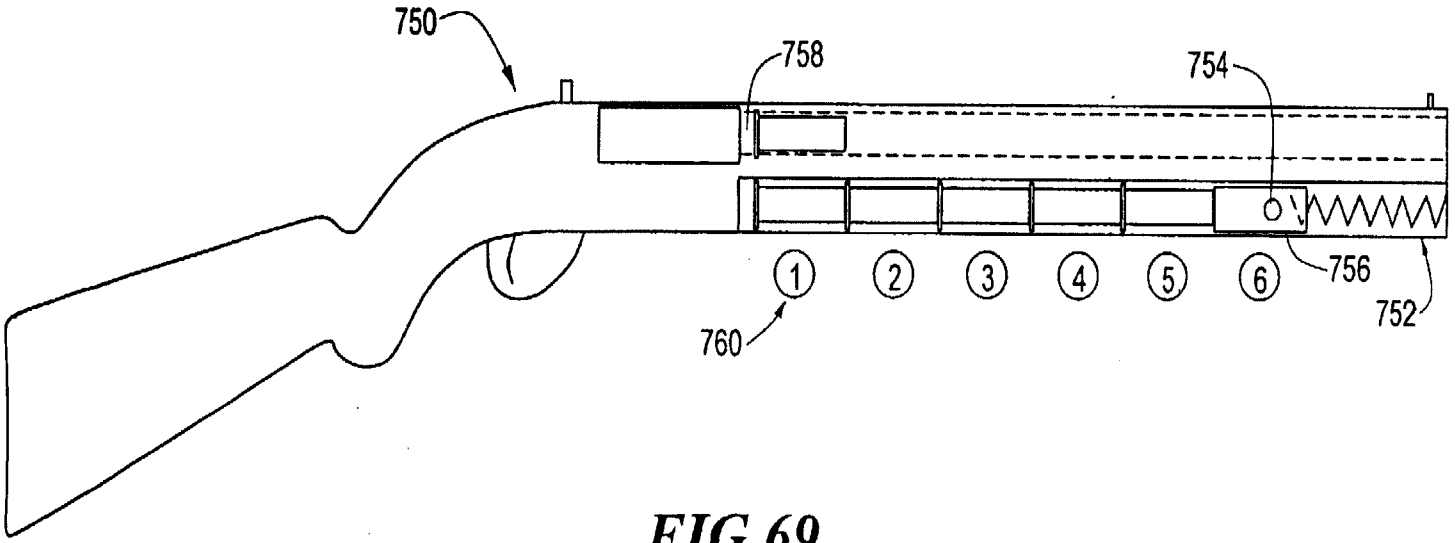

FIG. 68 is a side sectional elevational view of a firearm specially modified to accept the monitoring and indicator system according to this invention; and FIG. 69 is a side elevational view of a firearm with a loaded tubular magazine and a fully compressed follower element provided with a number of magazine switch elements corresponding to the number of cartridges in the magazine and an additional chamber switch element.

Figure 1:
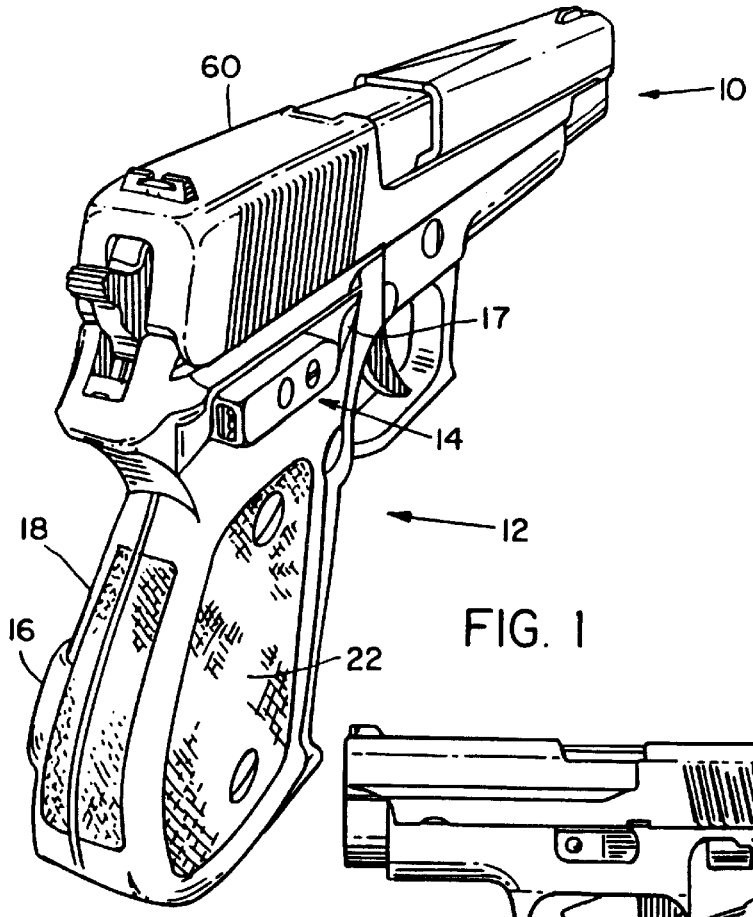
FIG. 1 is a perspective view of a semi-automatic pistol utilizing the automatic cartridge monitoring and indicator system according to this invention.
Figure 2:
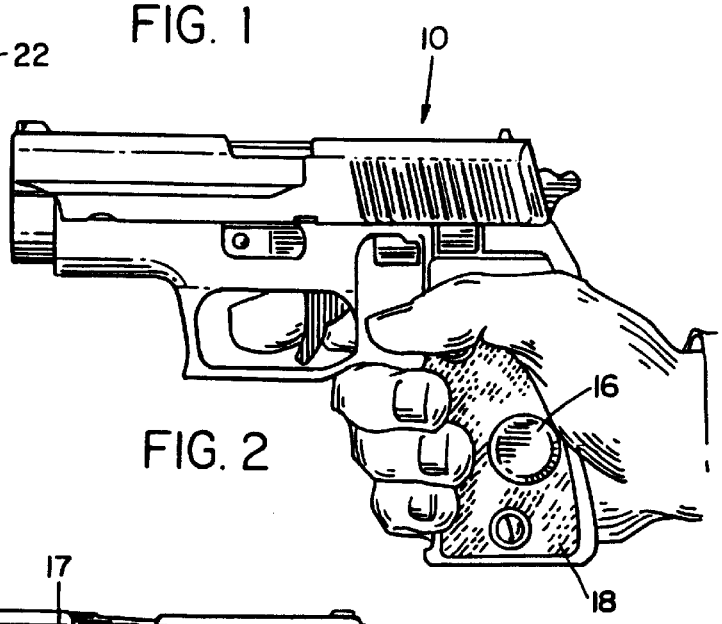
FIG. 2 is a left side view of the firearm of FIG. 1 illustrating the position of the battery compartment.
Figure 3:
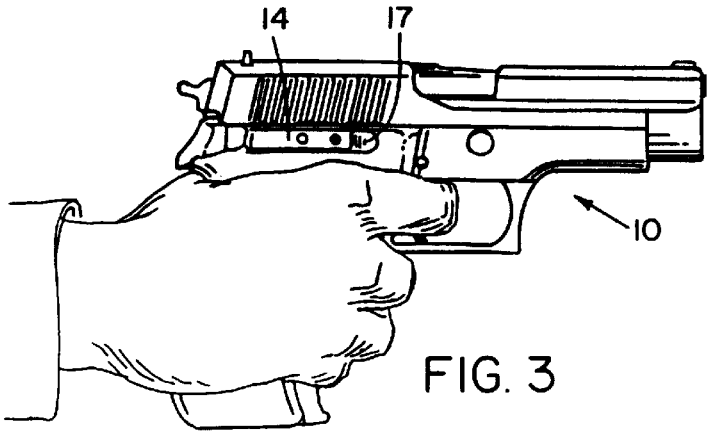
FIG. 3 is right side view of the firearm of FIG. 1 illustrating the position of the indicator device.
Figure 4:
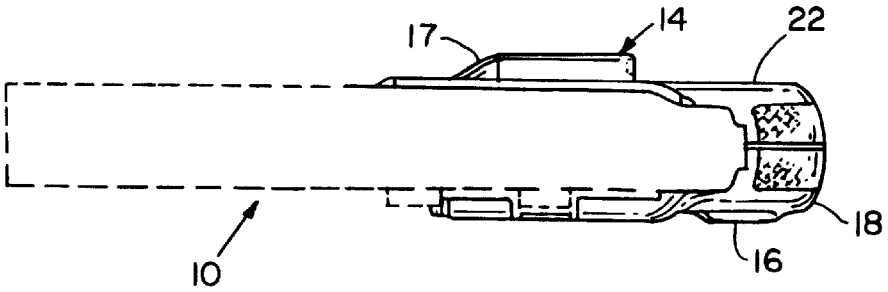
FIG. 4 is a top plan view of a portion of the firearm of FIG. 1 showing both the indicator device and battery compartment.
Figure 5:
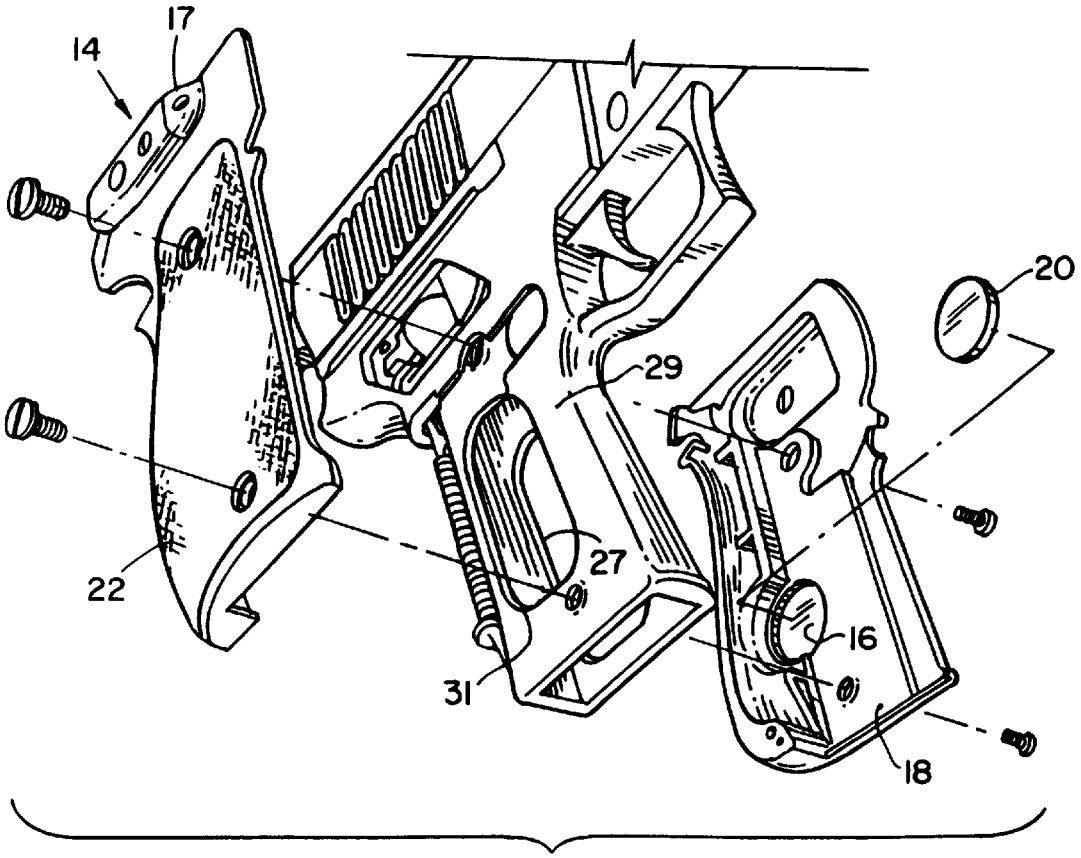
FIG. 5 is a view of the firearm of FIG. 1 with the handle grips exploded out showing the battery compartment.

Throughout the specification and drawings like elements have been given like numbers and similar elements like numbers accompanied by a lower case letter or a prime. There is shown in FIG. 1 firearm 10 including the monitoring and indicator device 12 according this invention including indicator device 14 and battery housing 16 on left handle grip 18. Dummy plug 17 engages and seals (waterproofs) the remote data connector. The small, compact nature of system 12 and its ergonomic elegance can be seen in FIGS. 2 and 3, where the protruding battery housing 16, FIG. 2, and indicator device 14, FIG. 3, are small, unobtrusive, and do not interfere with the hand of the user. The limited bulk of battery housing 16 and indicator device 14 are shown even more dramatically in FIG. 4. Battery 20, FIG. 5, fits inside of battery housing 16 in left handle grip 18. Right handle grip 22, which carries indicator device 14, has its internal portion revealed in FIG. 6, where a switching device 24 can be seen including plate 26 and three switching elements 28, 30 and 32 that are engaged by actuator 34 slidable in slot 36 in magazine 38. Plate 26 is received in aperture 27, FIG. 5, of frame handle or receiver frame 29 and is flush with the interior magazine chamber wall 31. Actuator 34 does not appear in slot 36, FIG. 7, until there are only a predetermined number of cartridges spent or, conversely, there are a predetermined number of cartridges remaining in firearm 10. When that point occurs, actuator 34, FIG. 8, appears at the low end of slot 36.

Figure 9:
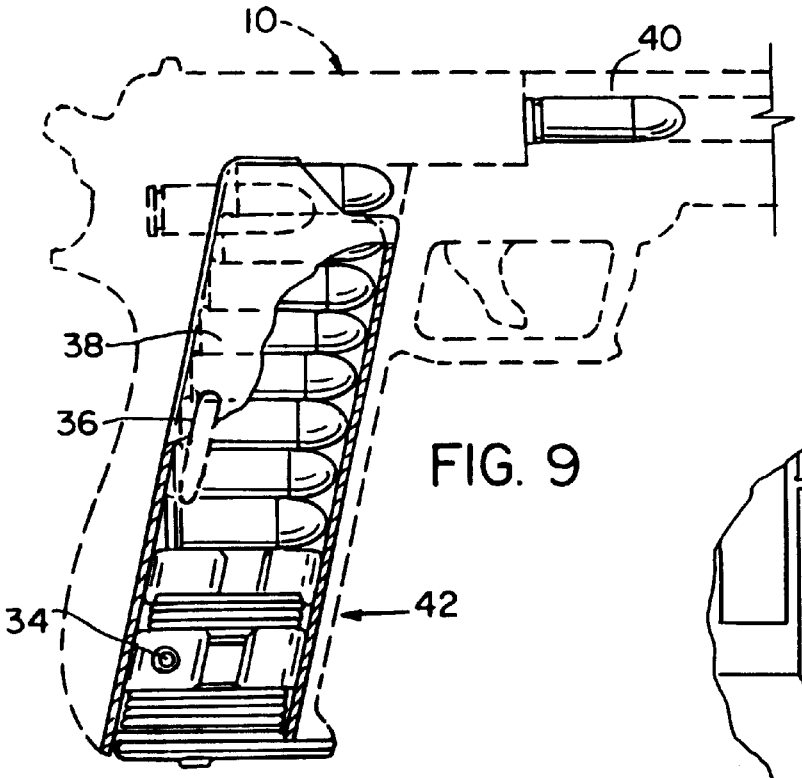
FIG. 9 is a side elevational view, with the firearm shown in phantom, of a loaded magazine with a fully compressed follower mechanism.
Figure 11:
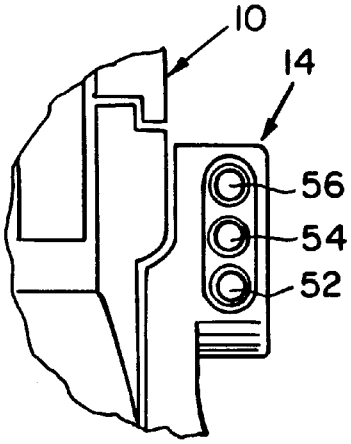
FIG. 11 is an enlarged view of the display device in the black condition where none of the indicator alarm lights are energized.
Figure 10:
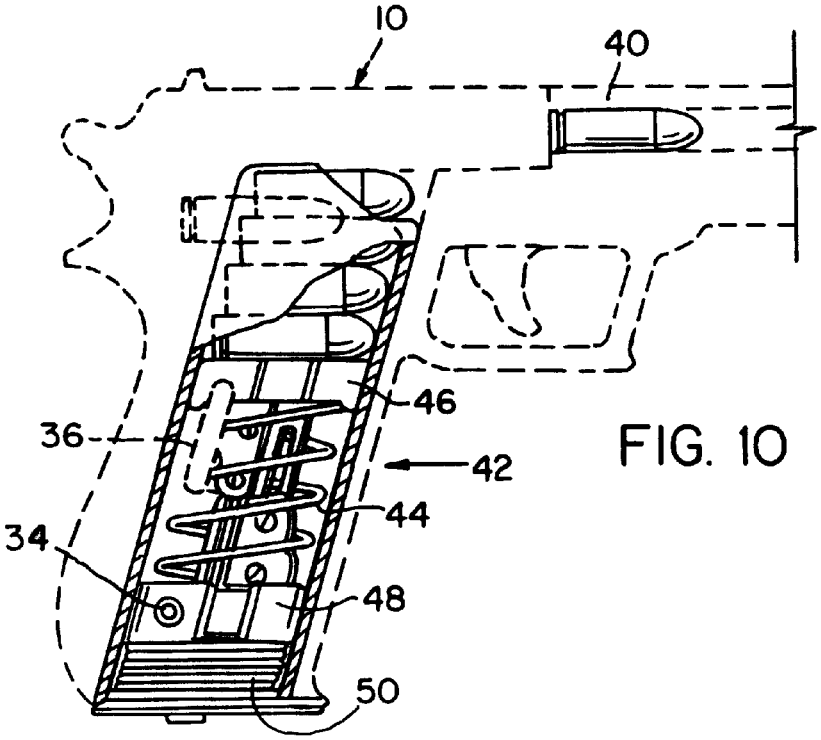
FIG. 10 is a view similar to FIG. 9 with the magazine with five cartridges remaining and the follower mechanism extended.

When firearm 10 is fully loaded, FIG. 9, with, for example, fifteen cartridges in doublestack magazine 38 and one in the chamber 40, follower mechanism 42 is fully compressed. As firing commences and cartridges are expended, the upper, stronger spring 44, FIG. 10, separates follower element 46 from follower intermediate element 48 while the lower, weaker spring 50 remains compressed. Since the upper spring 44 is stronger it fully extends before spring 50 begins to extend, thereby firmly and early setting the distance from follower element 46 to intermediate element 48, enabling accurate measuring of the cartridge level. At this point the three display lights 52, 54 and 56, FIG. 11, which may for example be different colors such as green, yellow and red, respectively, are dark, and this is known as the black condition. The red light stays on even after the last cartridge is fired, indicating an empty condition. If the firearm fails to fire and the red light is not energized that indicates a jam or other malfunction. In this particular embodiment three lights are used, but one or any number may be used, and also in this embodiment three lights are used to indicate three, two and one cartridges left, but this too is not a necessary limitation of the invention. In addition, although throughout this specification the indicator device is shown as a visual display, this is not a necessary limitation of the invention as other types of signalling, such as sound, infrared for night vision security, or other means could be used. And various types of visual displays may be used, e.g., symbols, lights, alphanumeric characters.

Figure 12:
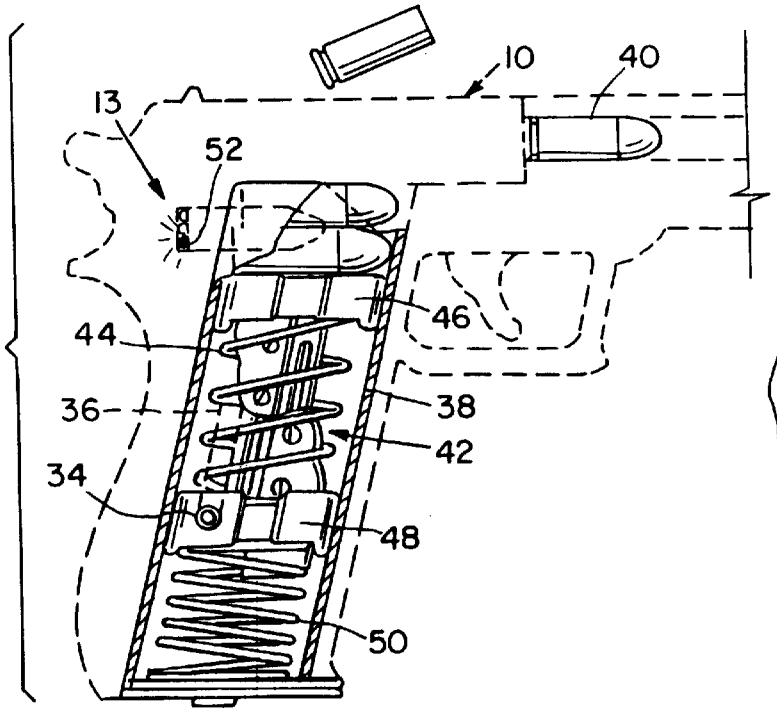
FIG. 12 is a view similar to FIG. 10 in which the second spring of the follower mechanism is extended, there are three cartridges remaining, one in the chamber of the firearm and two in the magazine and the first of three lights, a green one, is lit.
Figure 13:
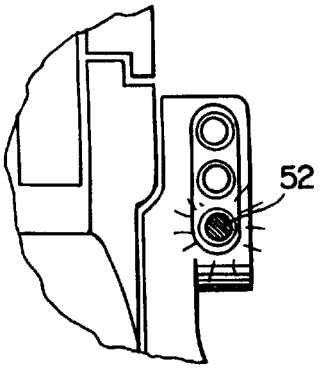
FIG. 13 is an enlarged end view showing the lighted green light.
Figure 15:
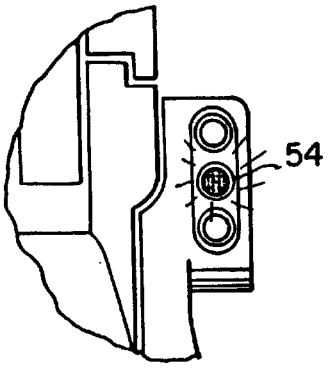
FIG. 15 is a view similar to FIG. 13 showing the lit second, yellow, light.
Figure 14:
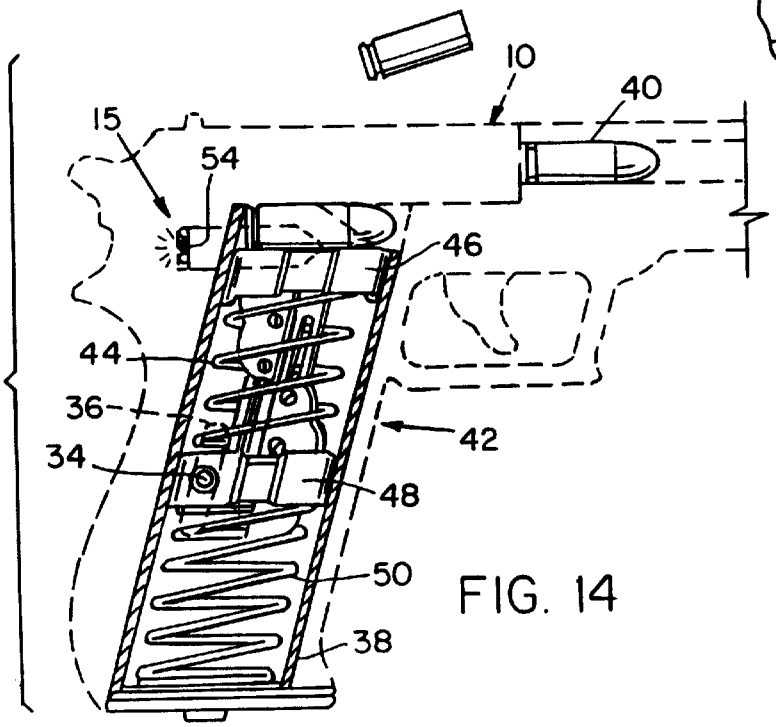
FIG. 14 is a view similar to FIG. 12 with one cartridge in the firearm chamber and one in the magazine, with the second, yellow light, lit.
Figure 16:
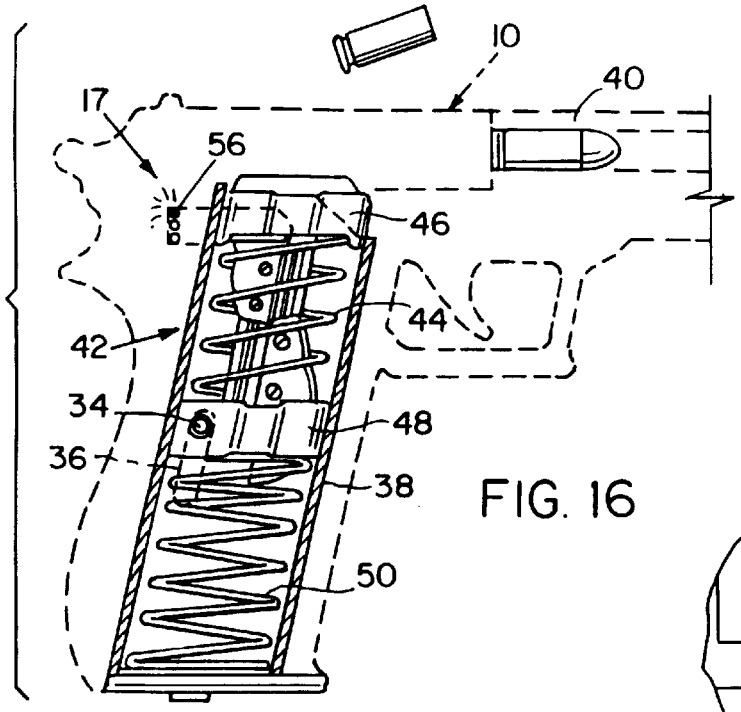
FIG. 16 is a view similar to FIGS. 12 and 14 with both springs of the follower mechanism extended, only one cartridge left in the firearm chamber, and the third, red, light lit.
Figure 17:
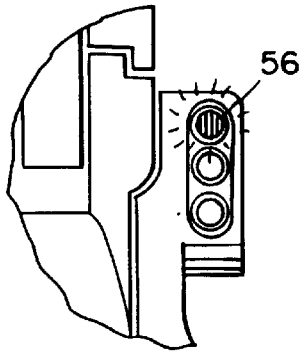
FIG. 17 is a view similar to FIG. 15 showing the third, red, light lit indicating that the firearm is out of ammunition.
Figure 18:
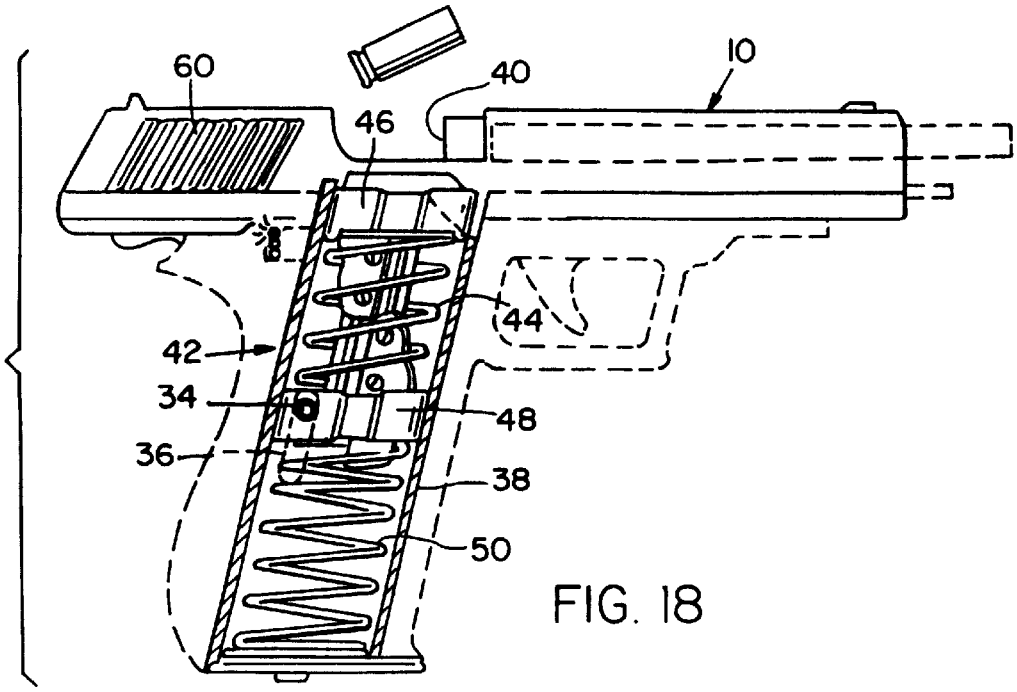

As firing progresses from this point, there will eventually occur the situation where there is one cartridge in chamber 40 of firearm 10 and two in magazine 38, FIG. 12. At this point in this embodiment lower spring 50 has begun to uncoil and actuator 34 has engaged the first switch 28, FIG. 6, so that the green light 52, FIG. 13, comes on indicating that there are three cartridges left, two in the magazine and one in the chamber. As lower spring 50 uncoils it pushes follower element 42 upwards to continue feeding cartridges. Follower element 42 stays completely open while under pressure from lower spring 50 throughout feed of cartridges from magazine 38. When that round is fired and there is but one left in the chamber and one in the magazine, FIG. 14, the second, yellow, light 54, FIG. 15, is energized. Following this, when there is but one cartridge left in chamber 40, FIG. 16, the third and last, red, light 56, FIG. 17, is energized. After this, even though there are no more cartridges to be fired, the red light stays on as long as an empty magazine is in place, and with the slide 60 locked back to indicate an empty firearm, as in FIG. 18. When the shooter releases the empty magazine 38, FIG. 18, from the firearm, the switch opens and deenergizes the red light. The system will then reset itself when a fresh magazine with an adequate supply of ammunition is inserted into the firearm.

Monitoring and indicator device 12 on firearm 10 includes a predetermined number of magazine switch elements corresponding to a predetermined number of cartridges within magazine 38 whose level is to be monitored and one additional chamber switch element to account for the cartridge in the firing chamber. As described above, there are provided three switch elements 28, 30 and 32 which are engaged by actuator 34 when there are two cartridges remaining in magazine 38 and one in the chamber; one cartridge remaining in magazine 38 and one in the chamber; and zero cartridges in magazine 38 and one in the chamber, respectively. There are two magazine switch elements corresponding to the cartridges in magazine 38 whose level is to be monitored and there is an additional chamber switch element, for a total of three, to account for the cartridge in the chamber. In this manner, using only actuator 34 moving with follower mechanism 42 to engage switching elements 28, 30 and 32, monitoring and indicator device 12 accurately and efficiently-monitors the level of a predetermined number (two) of cartridges in magazine 38 and the one in the chamber of firearm 10.

In contrast, one prior art system used a magnet on the follower mechanism to monitor only the level of cartridges in the magazine. See U.S. Pat. No. 5,303,495. Thus, according to the teachings of that patent, only two Hall effect switches would be used to monitor the last two cartridges in the magazine. Another system uses the follower mechanism to determine only the level of cartridges in the magazine and requires an external sensor to monitor the movement of the slide of the firearm and complex circuitry to determine from the level of cartridges in the magazine and the sensor the total number of cartridges in the firearm. See U.S. Pat. No. 5,052,138.

While many embodiments described throughout this application monitor the level of two cartridges in the magazine and an additional cartridge in the chamber, this is not a necessary limitation of this invention. There could be as few as a single switch element. In that case only the cartridge in the firing chamber is monitored and the predetermined number of cartridges to be monitored in the magazine is equal to zero. Or the predetermined number of cartridges in the magazine whose level is to be. monitored can be as many as the magazine can hold. In that case there would be provided a number of magazine switch elements corresponding to the number of cartridges the magazine can hold and an additional chamber switch element to account for the cartridge in the firing chamber of the firearm.

Figure 17A:
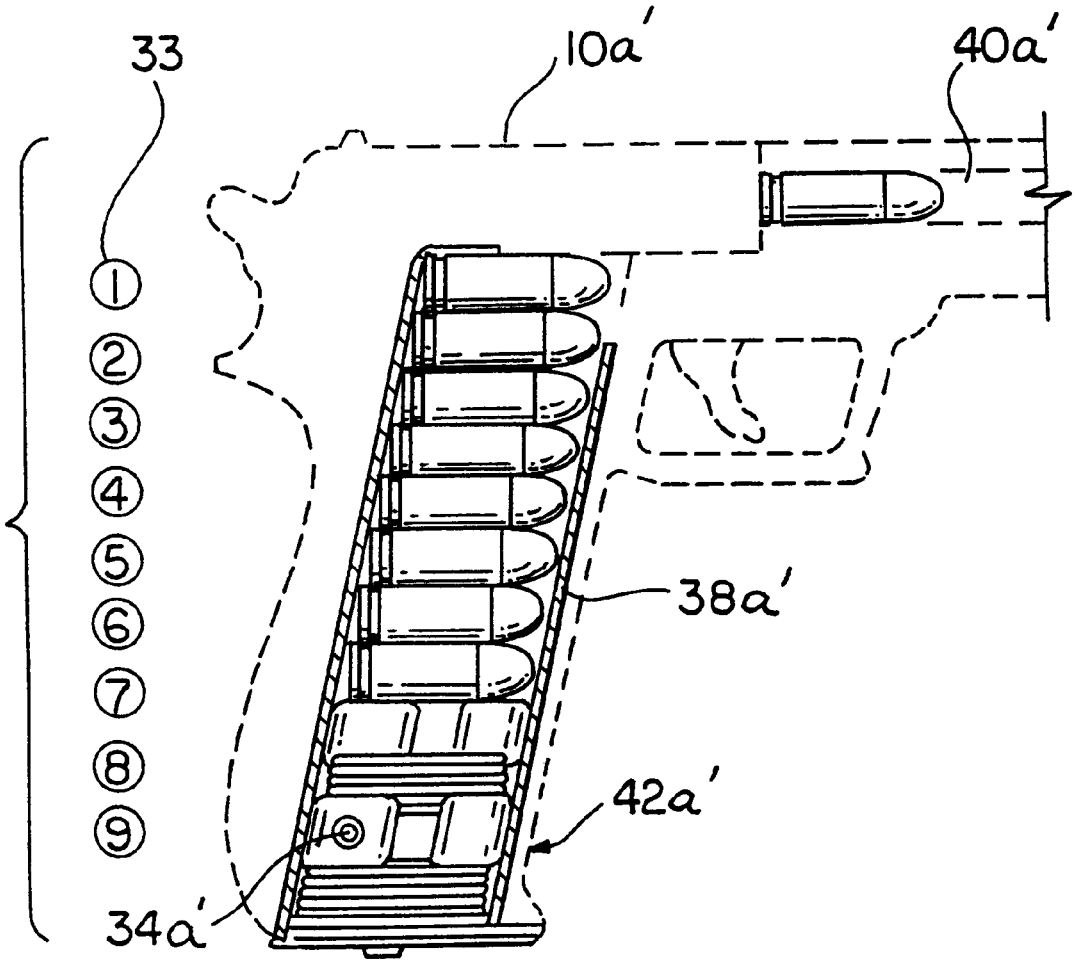
FIG. 17A is a side elevational view of a firearm with a loaded magazine and a fully compressed follower element provided with a number of magazine switch elements corresponding to the number of cartridges in the magazine and an additional chamber switch element.

This embodiment is depicted in FIG. 17A. Firearm 10*a*', FIG. 17A, is fully loaded with eight cartridges in single stack magazine 38*a*' and one in firing chamber 40*a*'. Actuator 34*a*' is affixed to follower mechanism 42*a*' which is fully compressed. Follower mechanism 42*a*' differs from follower mechanism 42 in that it does not include and intermediate follower element and two springs. Also the follower itself and not the intermediate follower element carries the actuator. Since the switch elements which actuator 34*a*' would engage are not visible in this view, a representation of the actual switch elements is indicated at 33. When firearm 10*a*' is fully loaded actuator 34*a*' is aligned with the ninth switch which indicates that there are nine cartridges in the firearm, eight in the magazine 38*a*' and one in firing chamber 40*a*'. As the cartridges are fired from firearm 10*a*' follower mechanism 42*a*' feeds cartridges from magazine 34*a*' into firing chamber 40*a*'. The upward movement of actuator 34*a*' causes it to engage each switch consecutively so that it keeps an accurate count of the total number of cartridges in firearm 10*a*' at all times including the cartridges in magazine 38*a*' and firing chamber 40*a*'. When follower mechanism 42*a*' has reached its upper limit and there are no cartridges remaining in magazine 38*a*', actuator 34*a*' is aligned with the first switch indicating there is a single cartridge remaining in firearm 10*a*' and that cartridge is in firing chamber 40*a*'.

As noted above, in contrast to the prior art systems the system according to this invention includes a number of magazine switch elements corresponding to the predetermined number of cartridges in the magazine (in this case 8) and an additional chamber switch element corresponding to the single cartridge in the firing chamber. Because of this unique design, the system of this invention easily and accurately monitors the level of cartridges in both the magazine and the firing chamber.

Figure 19:
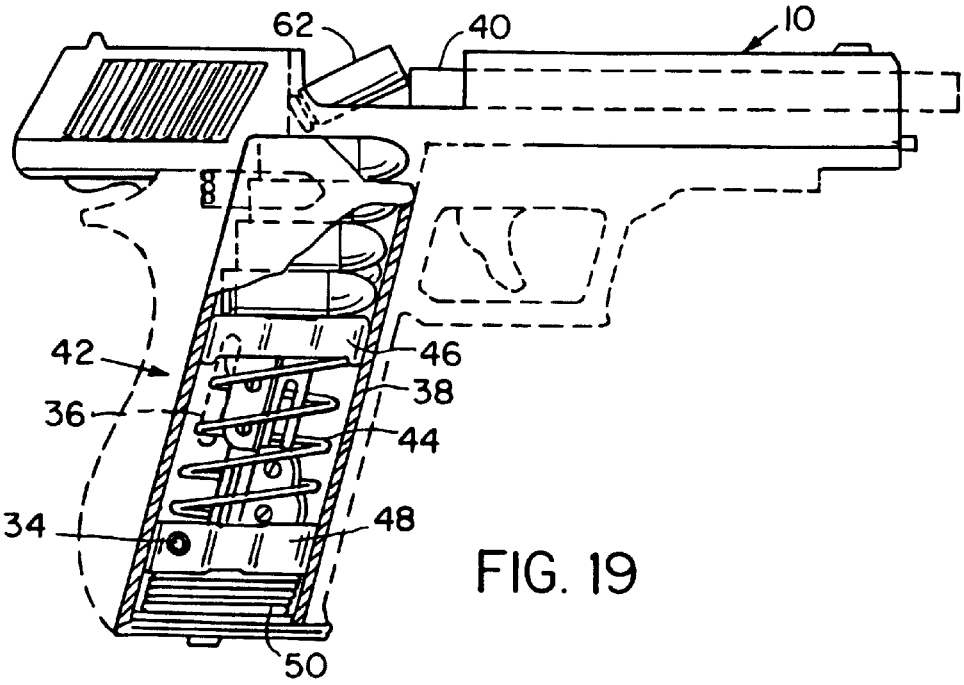
FIG. 19 is a view similar to FIG. 10 in which a cartridge has become caught in the mechanism so that the gun will not fire and the indicator is in the black condition with no lights lit, indicating a jammed condition.

The system has the added advantage of indicating when the firearm is not functioning because of a malfunction and not because of a lack of ammunition. For example, when a spent cartridge casing 62, FIG. 19, is jammed in chamber 40, and there is ample ammunition in magazine 38, no red light energized 56, FIG. 17, since the actuator is not at a level where it can engage the last switch 32, FIG. 6.

Figure 20:
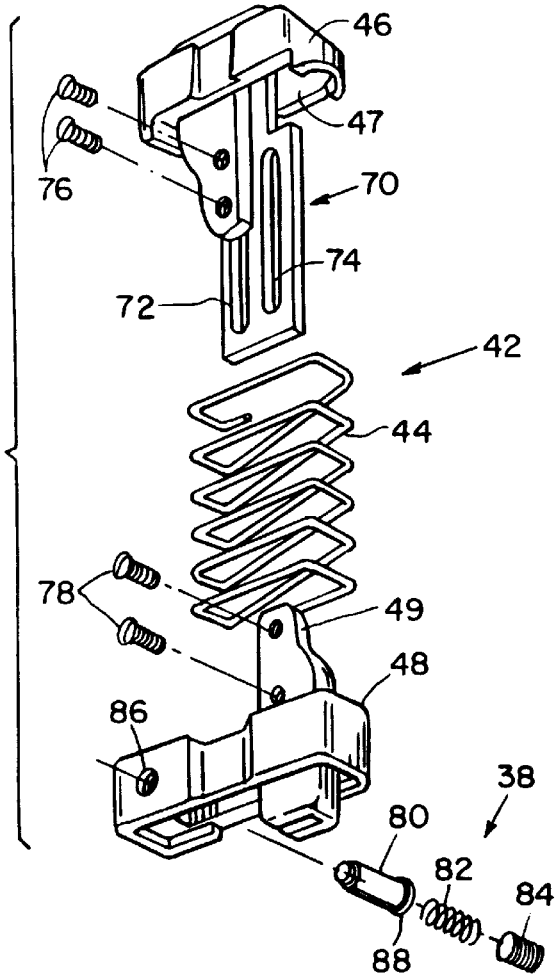
FIG. 20 is an exploded three-dimensional view of a two-part follower mechanism with actuator according to this invention.
Figure 22:
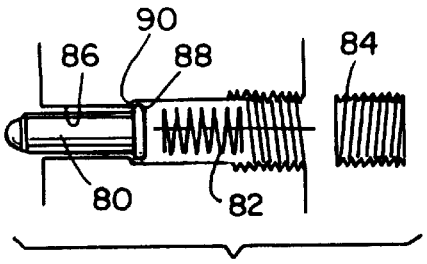
FIG. 22 is a side sectional elevational view of a portion of the intermediate element of the follower mechanism of FIG. 20 showing the installation of the actuator.
Figure 21:
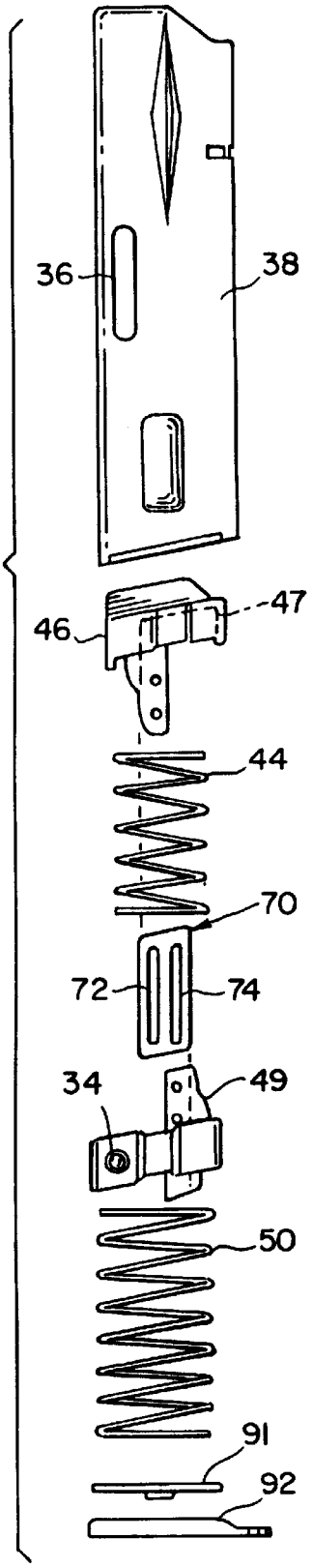
FIG. 21 is an exploded three-dimensional side view of the two-part follower mechanism of FIG. 20 with the magazine and springs.

Follower mechanism 42 is shown in greater detail in FIG. 20 along with single-ended actuator, where it can be seen that follower element 46 is interconnected with intermediate element 48 by means of limiter 70 which includes two slots 72 and 74, that enable elements 46 and 48 to move toward and away from each other to the limit allowed by limiter 70. Cavity 47, FIG. 20, inside follower element 46 accepts the top of post 49, FIG. 20, and the top of limiter 70 when follower element 42 is compressed. Screws 76 and nuts (not shown) mount limiter 70 through slot 72 to follower element 46 while screws 78 and nuts (not shown) mount limiter 70 through slot 74 to intermediate element 48. In this way spring 44 is enabled to urge apart elements 46 and 48 only to the limit allowed by limiter 70. Actuator 38 includes a single actuator element 80 urged outward by spring 82 mounted against threaded base 84, all of which fit in bore 86 in intermediate element 48, as can be seen more clearly in FIG. 22, wherein the rear flange 88 of actuator element 80 acts to retain it in bore 86 against shoulder 90. Lower, weaker spring 50 nests in the bottom of intermediate element 48 and rests on lock plate 91, FIG. 21, on the floor plate 92 of magazine 38.

Figure 23:
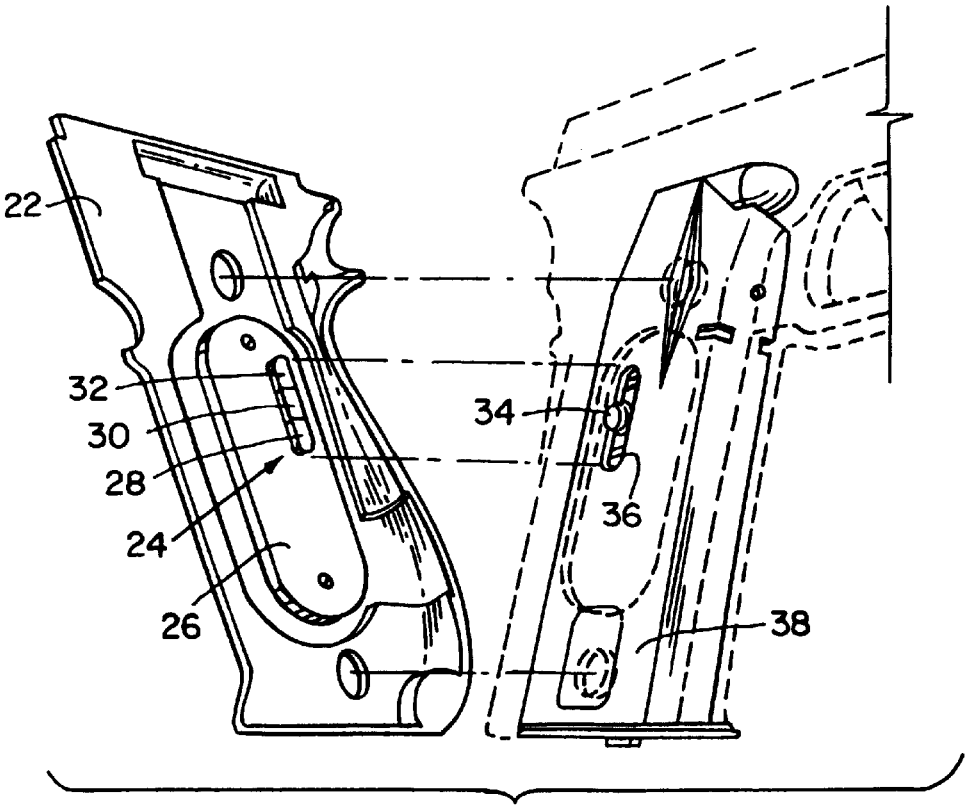
FIG. 23 is an exploded three-dimensional view showing a switching device mounted in the handle grip and the actuator protruding from an aperture in the magazine.
Figure 25:
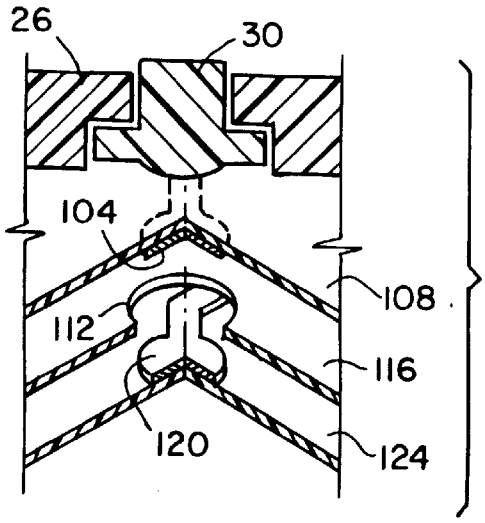
FIG. 25 is an enlarged detailed view of one operator and its associated membrane switch.
Figure 24:
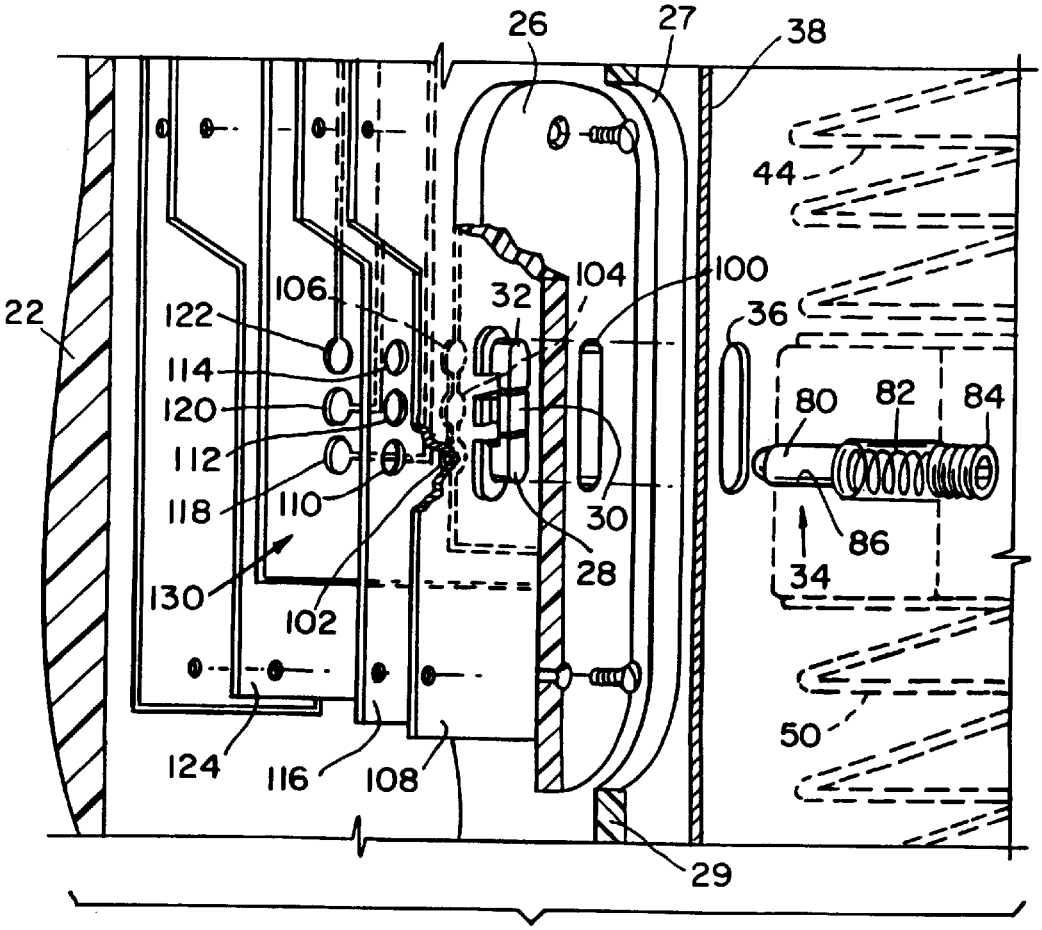
FIG. 24 is an enlarged exploded view of the switching device and actuator with portions broken away.

Actuator 34, FIG. 23, protrudes from slot 36 in magazine 38 to engage switching device 24 which includes the three operator members 28, 30 and 32 mounted on grip 22 by plate 26. The three operator elements 28, 30 and 32 extend through slot 100, FIG. 24, which aligns with slot 36 in magazine 38. The pressure of actuator 34 on each one of operators 28, 30 and 32 causes them to engage, respectively, contacts 102, 104 and 106, FIG. 24, on sheet 108 through holes 110, 112 and 114 in sheet 116 to engage contacts 118, 120 and 122 on sheet 124 which constitute a membrane. These are known as membrane switches, one of which is shown in greater detail in FIG. 25, where portions have been cut away for clarity. The membrane construction may also be used to house the battery, but one integral membrane can house the battery electrically interconnected with the switching device, and also house the switching device itself as shown with respect to FIGS. 24 and 25.

Figure 26:
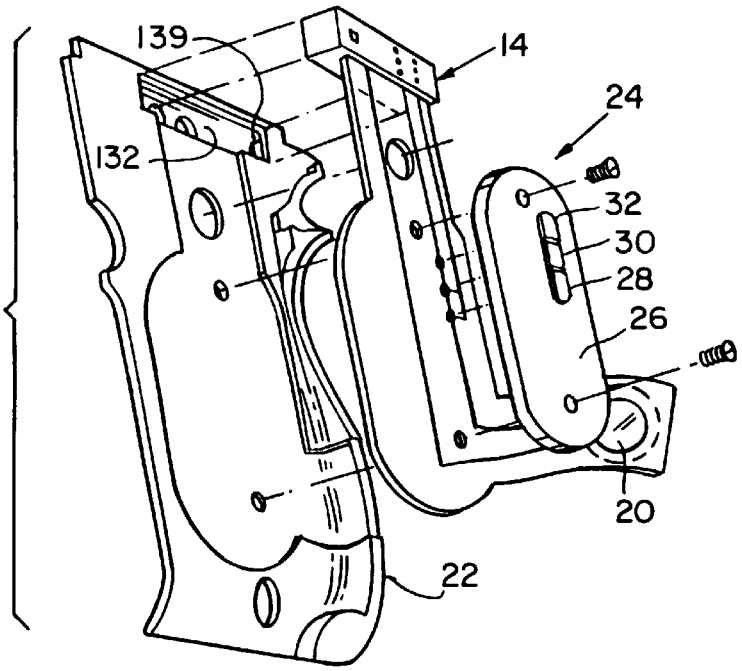
FIG. 26 is an exploded view showing a handle grip with the switching device and the indicator device.
Figure 27:
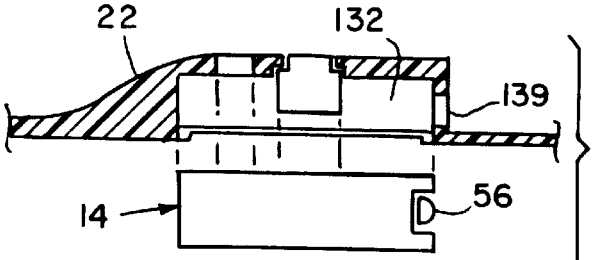
FIG. 27 is a top plan view showing the fit of the indicator device in the handle grip.
Figure 28:
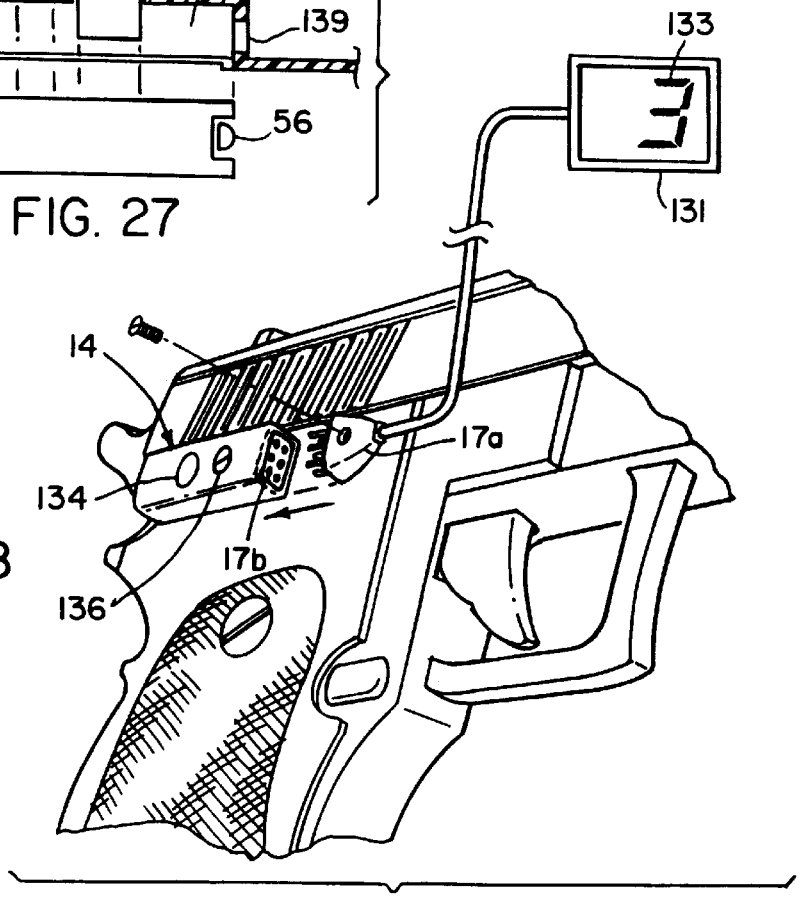
FIG. 28 is an enlarged three-dimensional view of the indicator device, the test button, brightness adjustment, and remote data connector.

The entire monitoring and indicator system according to this invention is installable on most firearms without any alterations or modifications to the firearm itself. Other firearms may require some alteration. All of the required circuitry and components may be mounted on a pair of handle grips which can replace the original equipment handle grips. The membrane 130, FIG. 24, which employs sheets 108, 116 and 124 and the attendant elements, may now be extended to hold battery 20 and may also be used to interconnect them with indicator device 14, FIG. 26. The indicator device fits snugly into recess 132 in handle grip 22, as can be seen more clearly in FIG. 27 and light 56 when energized can be seen through slot 139 in handle 22, FIGS. 26, 27. A test button 134, FIG. 28, and brightness adjustment device 136, FIG. 28, are mounted on the side of indicator device 14. The brightness adjustment 136 may be either a small potentiometer or variable resistor or it may be a photoresistor which is sensitive to ambient light conditions so that the brightness is automatically controlled. In FIG. 28 sealing plug 17, FIG. 1, has been removed and remote data connector 17*a* has been inserted in its place in receptacle 17*b* to deliver data to another remote device which may be a display device or an electronic circuit or digital processor 131 for further collecting, analyzing and/or recording or displaying the information such as in alphanumeric form 133.

Figure 29:
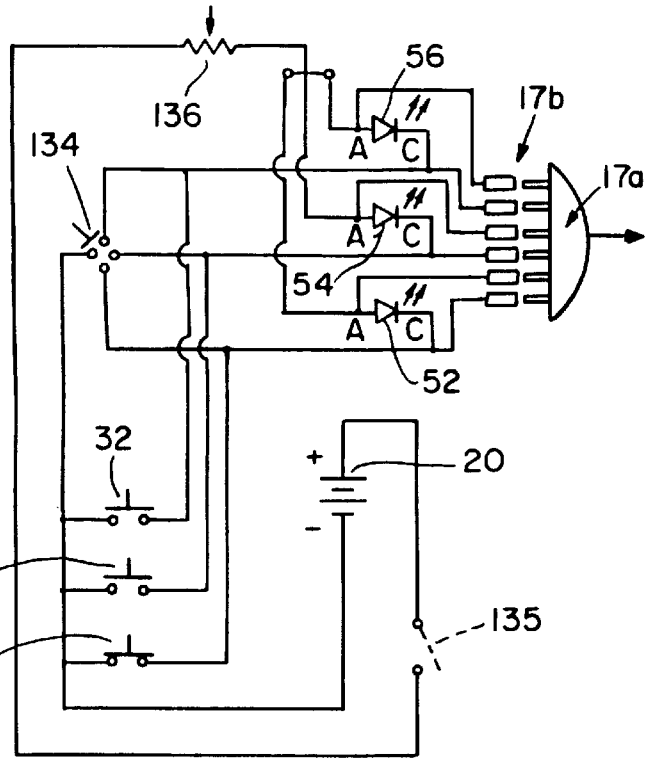
FIG. 29 is an electrical schematic diagram of the switching device alarm lights, battery, brightness adjustment, test button, and remote data connector.
Figure 30:
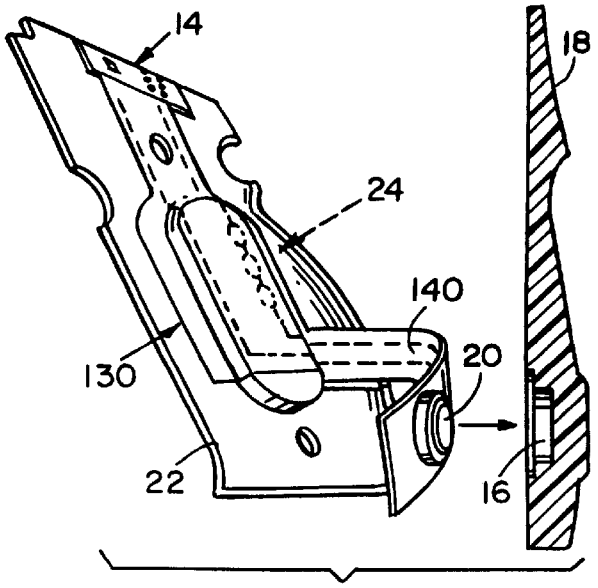
FIG. 30 is a three-dimensional view of the handles with portions in section showing the membrane interconnecting the indicator device and switching device on one handle grip and wrapping around the handle to connect with the battery in the other handle grip.

Test button 134, FIG. 29, connects battery 20 to each of the lights 52, 54 and 56 such as implemented by LEDs so that the battery and the lights can both be checked. A conventional on-off switch 135 can be employed if desired. Photoresistor or variable resistor 136 directly controls the current flow to each of the LEDs to set the brightness. Switch 28 is shown closed while switch elements 30 and 32 are shown open. The use of the single continuous membrane 130 to interconnect indicator device 14, switching device 24 and battery 20 is shown to advantage in FIG. 30, where battery housing 16 and handle grip 18 readily receive battery 20 in membrane 130. While the remaining portion of the membrane 140 wraps around between handle grips 18 and 22 and extends beyond switching device 24 to indicator device 14. Since there is no on-off switch the system is on whenever actuator 34 engages any of switches 28, 30, 32.

Figure 31:
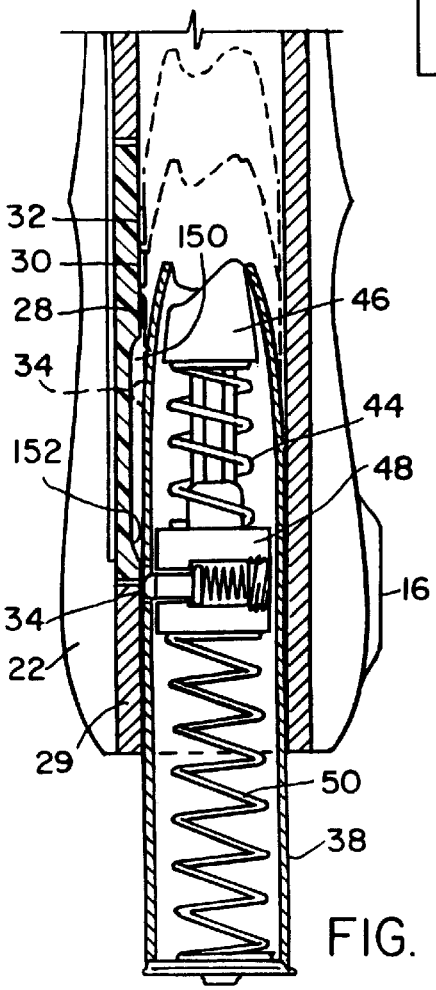
FIG. 31 is a sectional view of the handle of the firearm showing a camming recess for facilitating free-fall release of the magazine.

In order to facilitate free-fall easy release of magazine 38, FIG. 31, a camming recess 150, FIG. 31, may be provided on the inside of handle grip 22 so that when the magazine is released and begins to drop out, actuator 34 protruding from slot 36 first has room to be in its extended position without forcefully contacting the wall so that magazine 38 can fall freely. By the time actuator 34 reaches the lower curved camming surface 152 there is enough energy for the actuator to be gently cammed inwardly by the receiver frame 29 without interfering with the free-fall release of magazine 38.

Figure 32:
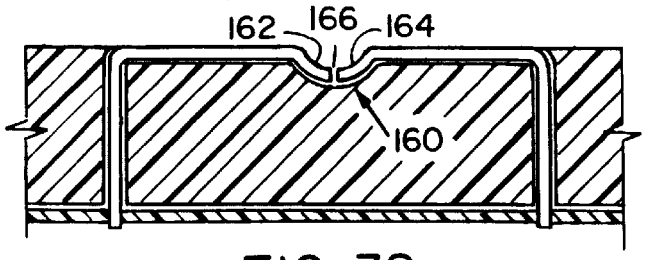
FIG. 32 is a side sectional view of another type of switching element according to this invention.
Figure 33:
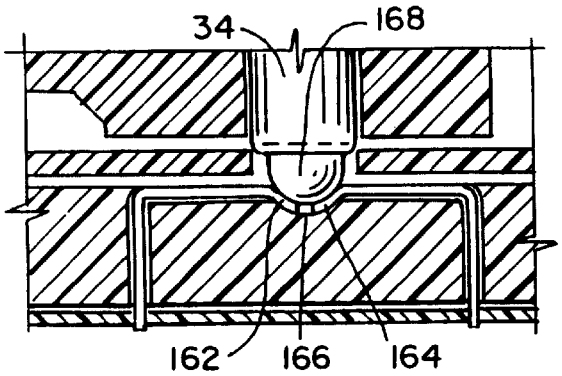
FIG. 33 is a view similar to FIG. 32 with the addition of the actuator positioned to short or close the switch element.
Figure 34:
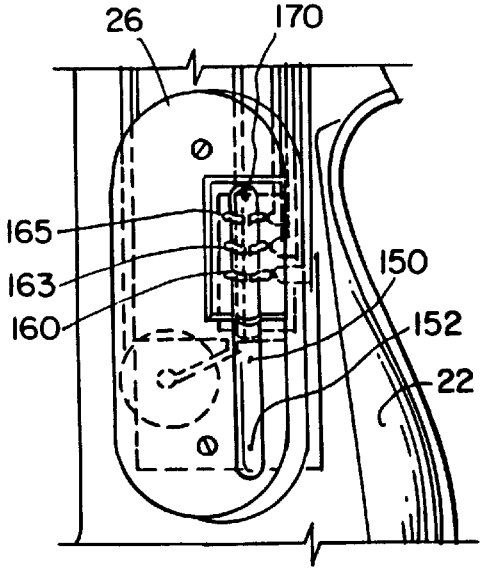
FIG. 34 is an elevational plan view of the switching device showing a gang of three switches as shown in FIGS. 32 and 33.

Another simpler type of switch element 160, FIG. 32, useful in this invention, includes simply two conductors 162 and 164 with a small space 166 between them. When the conductive tip 168, FIG. 33, of actuator 34 bridges gap 166, it shorts or connects conductors 162 and 164 to each other, thereby closing the switch. Three such switches 160, 163 and 165, FIG. 34, installed at groove 170 of plate 26 are actuated by the tip 168 of actuator 34 as it moves along in groove 170 with the follower element or intermediate element or some other part of the follower mechanism. The switch construction in FIG. 34 permits much higher packing density to be more compatible with smaller systems such as used with 22 caliber ammunition.

Figure 35:
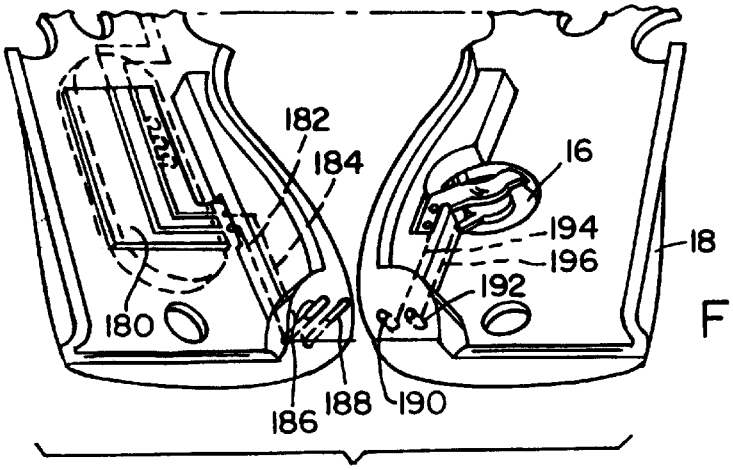
FIG. 35 is an axonometric view of two handle grips showing an alternative electrical interconnection between the grips.

In some constructions printed circuit boards 180, FIG. 35, may be desirable instead of the membrane construction. In that case, conductive paths between the battery in handle grip 18 and the other portions of the monitoring and indicator device may be made via conductors 182, 184, pins 186 and 188, sockets 190 and 192, and conductors 194 and 196.

Figure 36:
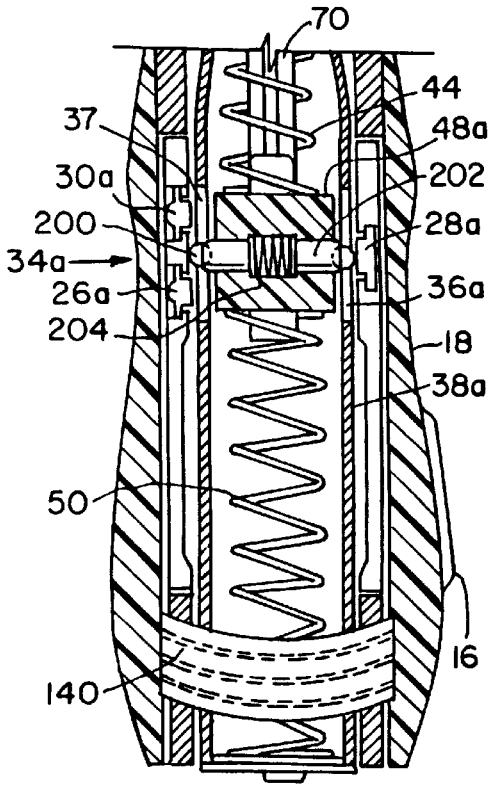
FIG. 36 is a cross-sectional view of a handle of a firearm showing a dual element actuator.

Although actuator 34 has been shown as a single ended actuator only, this is not a necessary limitation of the invention as actuator 34*a*, FIG. 36, may include one actuator element 200, 202 at each end at slots 36*a*, 37 with a biasing spring 204 between them. This provides two advantages. First, it enables switches 26*a* and 30*a* to be put on one side of magazine 38*a* and the middle switch 28*a* to be put on the other so that the switches can all be packed much more closely together. Further, it balances the forces between the magazine and the opposing walls of the magazine chamber so that magazine 38*a* will remain better centered and will free-fall more readily when released.

Figure 38:
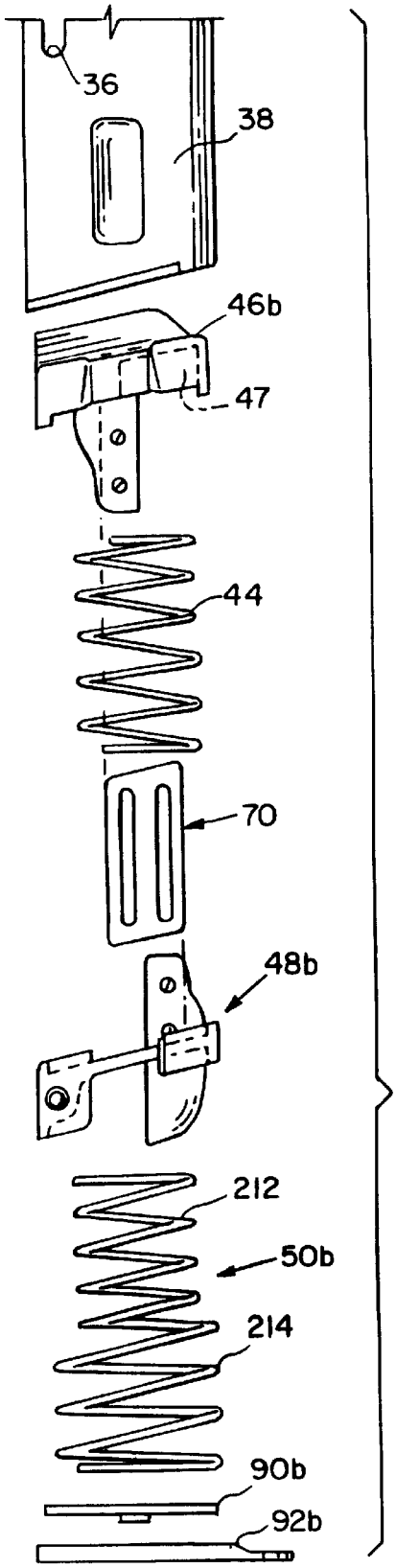
FIG. 38 is an exploded elevational view showing the magazine and complete follower mechanism using the intermediate element of FIG. 37.
Figure 37:
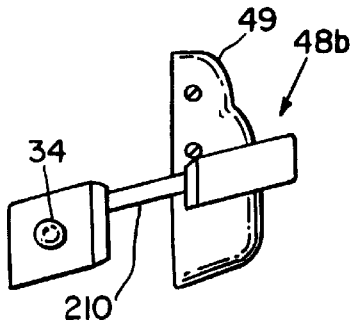
FIG. 37 is a side elevational view of an alternative follower mechanism intermediate element according to this invention.
Figure 39:
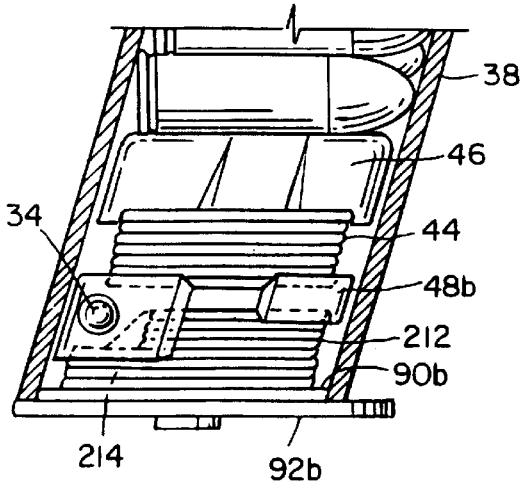
FIG. 39 is an enlarged detailed view of the follower mechanism of FIGS. 37 and 38 compressed in a fully loaded magazine.
Figure 40:
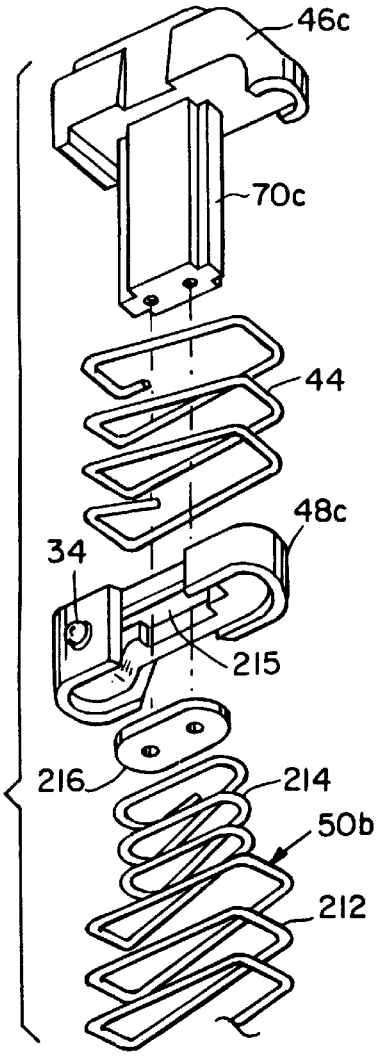
FIG. 40 is an exploded three-dimensional view of yet another follower mechanism according to this invention.

A smaller, more compact follower mechanism may be constructed using an intermediate element 48*b*, FIG. 37, which has a narrower body 210 and thereby reduces the overall height or length of the follower mechanism. In this construction, lower spring 50*b* is formed in two sections: an upper section 212 and lower section 214, FIG. 38. Upper section 212 is of a reduced diameter so that it can nest farther up in the body of narrower profile intermediate element 48*b*, FIG. 39, leaving enough room at one end for the larger portion needed to house actuator 34, while at the same time the larger lower portion 214 is large enough to properly seat on the plate 90*b* of magazine base 92*b*. Since spring 44 is the strongest spring it expands first under full load of the magazine, spring section 214 expands next, and finally spring section 212 expands operating under the lightest load with only a few rounds left. The limiter may be implemented in another embodiment, FIG. 40, by a simple post 70*c* received in hole 215 of intermediate element 48*c* and limited in its movement by plate 216 which is mounted by screws, not shown, to the bottom of post 70*c*.

Figure 41:
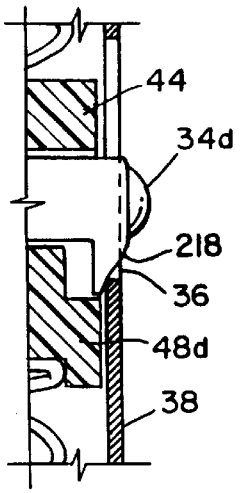
FIG. 41 is an enlarged detailed sectional view of an actuator having a camming surface to facilitate retraction of the actuator during loading of rounds into the magazine.
Figure 42:
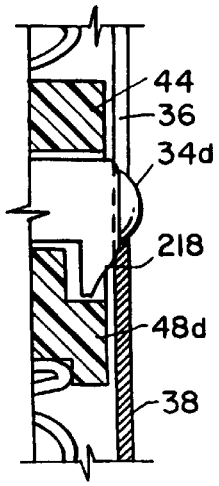
FIGS. 42 and 43 show the second and final steps in the retraction of the camming actuator of FIG. 41.
Figure 43:
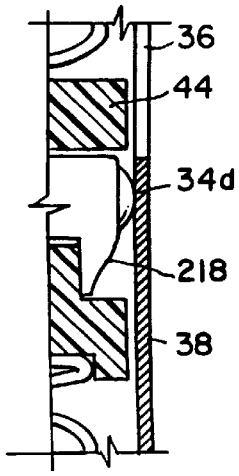

Another construction for facilitating the loading of cartridges into the magazine is shown in FIG. 41 where actuator 34*d* includes a camming surface 218 that bears on slot 36 and causes actuator 34*d* to retract as intermediate follower member 48*d* moves downwardly in magazine 38 during the loading of the cartridges into the magazine. Its intermediate position is shown in FIG. 42 and its totally retracted position is illustrated in FIG. 43.

In an alternative construction, switch operators 28*e*, 30*e* and 32*e*, FIG. 44, may be simple stampings or injection moldings on plate 26*e*, which create cantilevered fingers such as illustrated by finger 28*e*, FIG. 45, which can easily be pressed downwardly in the direction of arrow 220 to cause protrusion 222 to bear on the top of layer 224, thereby pushing contact 226 into electrical engagement with contact 228. Although not shown, any type of switch can be substituted in place of a membrane switch to be operated in conjunction with the described actuator system of this invention.

For magazines which have a tapered upper portion such as magazine 38*f*, FIG. 46, an opening 36*f* may be provided for permitting switching device 24*f* to protrude into the body of magazine 38*f* where it will be contacted by actuator device 34*f*. The raised angled position of switch operator elements 28*f*, 30*f* and 32*f* is shown to advantage in FIG. 47.

A follower mechanism 42*g*, FIG. 48, which is even more compact can be made where the springs line up next to each other, spring 44*g* which extends intermediate element 48*g* which carries actuator 34*g* still between intermediate element 48*g* and follower element 46*g*, spring 50*g* is connected directly to follower element 46*g* so that maximum use of the magazine capacity is not inhibited, as they compact side by side instead of on top of each other.

Figure 51:
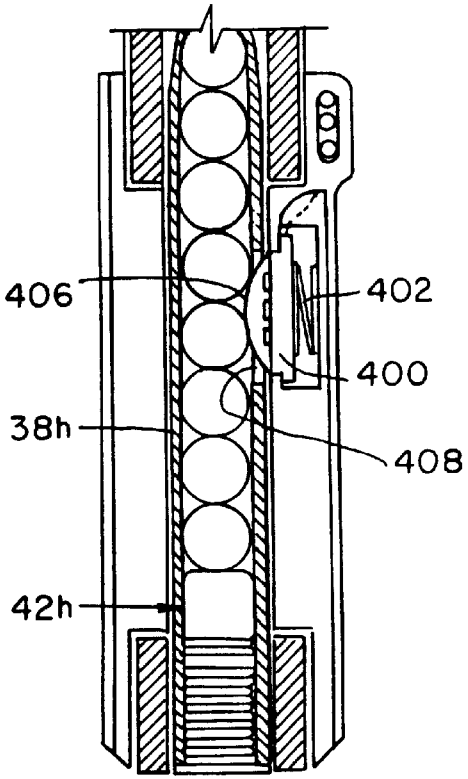
FIG. 51 is a view similar to FIGS. 49 and 50 with the magazine fully inserted and the switching device protruding into the magazine and contacting the rounds.
Figure 50:
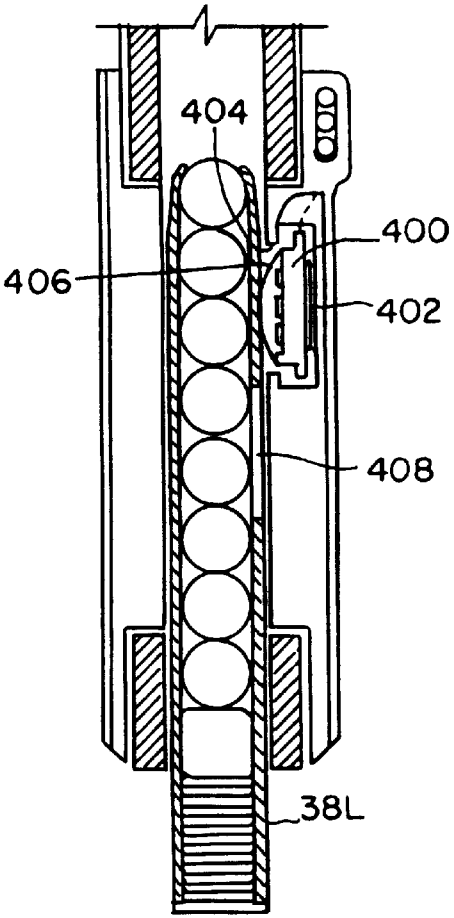
FIG. 50 is a view similar to FIG. 49 with the magazine further inserted and engaging the switching device.
Figure 49:
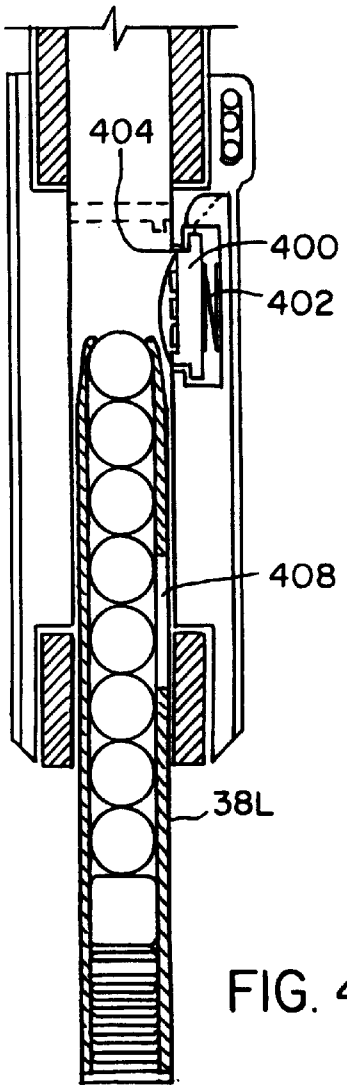
FIG. 49 is a schematic sectional view of the handle of a firearm showing an alternative spring loaded switching device with the magazine partially inserted but not engaging the switching device.
Figure 53:
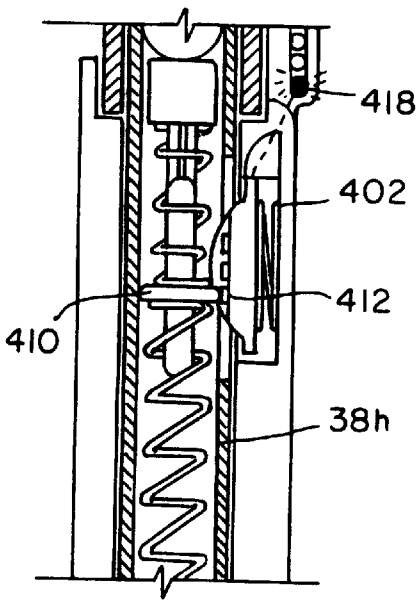
FIG. 53 is a view similar to FIG. 52 where the actuator has engaged the first of three switch elements indicating there are for example three cartridges left.
Figure 52:
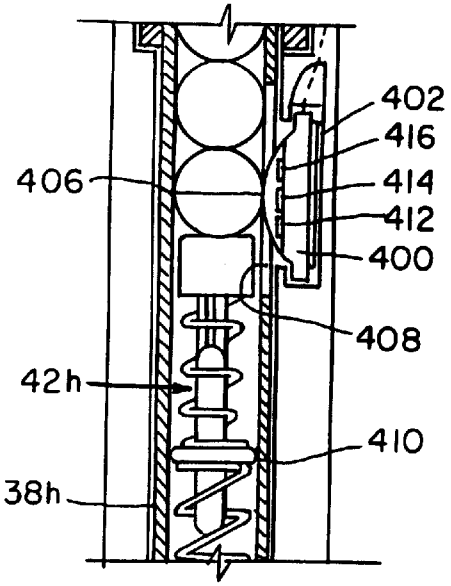
FIG. 52 is an enlarged detailed view of a portion of FIG. 51 before the actuator engages the switching device while there is still ample ammunition in the magazine.

In another configuration, the switching device may include a platform 400, FIG. 49, which is urged by spring 402 through hole 404 in the frame of a firearm. As magazine 38*h* with access hole 408 is inserted more fully, FIG. 50, the magazine pushes against camming surface 406 and drives platform 400 backward, collapsing spring 402, FIG. 50. When magazine 38*h* is fully seated, FIG. 51, platform 400 lines up with hole 408 in magazine 38*h*. Now, as the cartridges are expended and the follower mechanism 42*h* moves upwardly, actuator 410, FIG. 52, approaches access aperture 408, platform 400, and switches 412, 414 and 416, eventually, as shown in FIG. 53, actuator 410 engages the first of the switches 412 and lights an indicator light 418. Now, as the cartridges are stripped from the magazine 38*h*, FIGS. 51, 52, and the follower mechanism 42*h* moves upwardly, the camming surface 406 which is urged into the cartridges by spring 402, allows the cartridges to go freely by.

Figure 54:
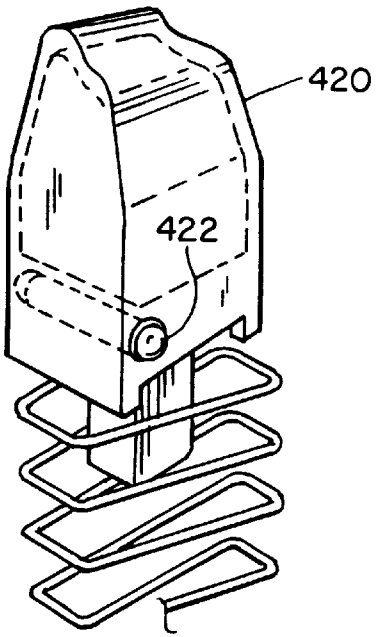
FIG. 54 is an enlarged detailed view of a portion of another follower mechanism according to this invention consisting of a single follower element with a double actuator mounted in it.

When the configuration of the gun frame is designed with an access aperture high enough to be compatible with a magazine aperture, the follower itself may carry the actuator 422 as shown in FIG. 54 (see also FIG. 17A), where the follower 420 carries dual ended actuator 422.

Figure 55:
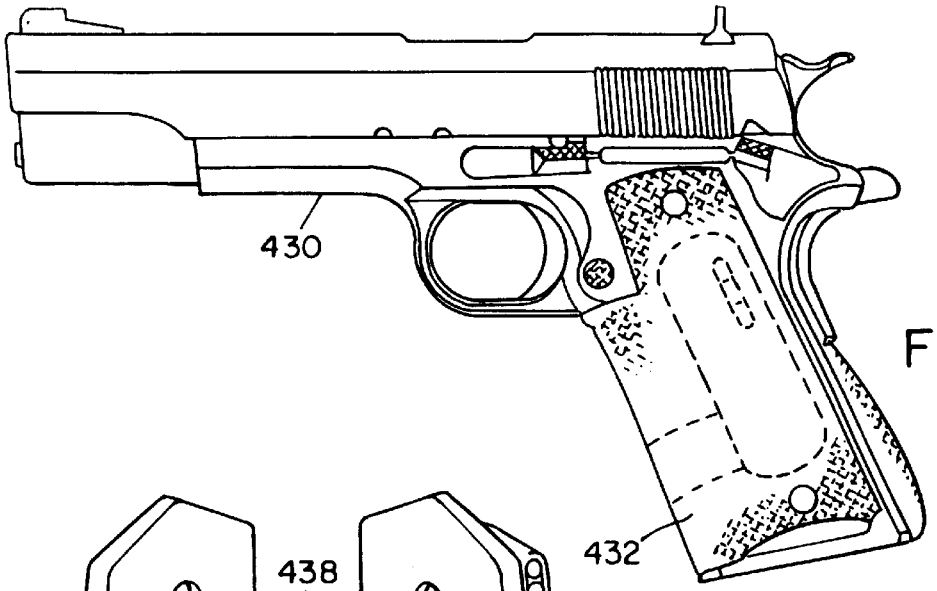
FIG. 55 is a side elevational view of a firearm showing two hand grips formed from a single piece which wraps around the front of the handle.
Figure 56:
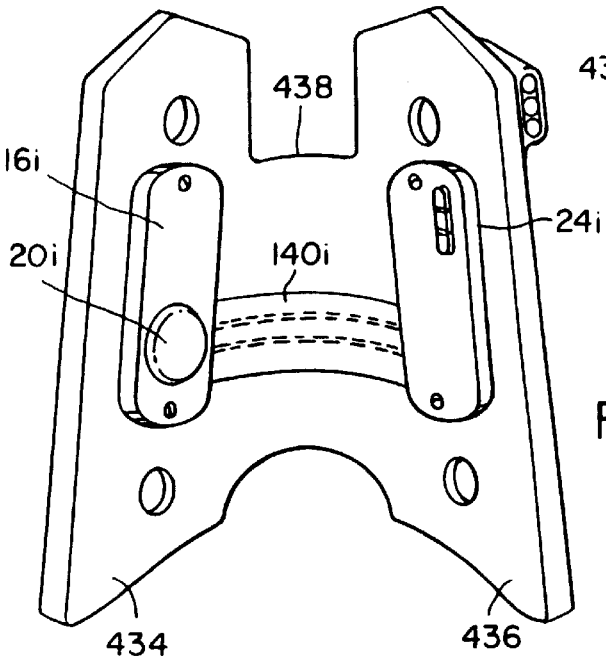
FIG. 56 is a three-dimensional view of the inside of the hand grip of FIG. 55 removed from the firearm assembly.

While thus far the interconnection between the circuitry in the opposite handle grips has been made through interconnection around the back of the firearm handle, this is not a necessary limitation of the invention. As shown in FIG. 55, the firearm 430 has an integral handle grip arrangement 432 in which the left 434 and right 436 handle grips are interconnected by member 438, FIG. 56, which wraps around the front of the firearm handle and carries membrane 140*i*. Note also in this configuration battery housing 16*i* is totally contained within the handle grips and does not protrude at all on the outside.

Figure 57:
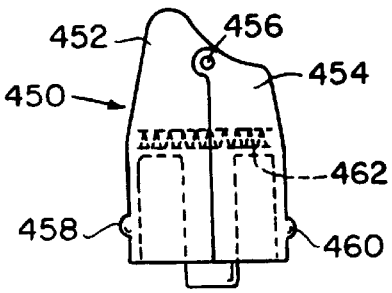
FIG. 57 is a side elevational view with portions shown in phantom of a split follower with double actuators according to this invention.
Figure 58:
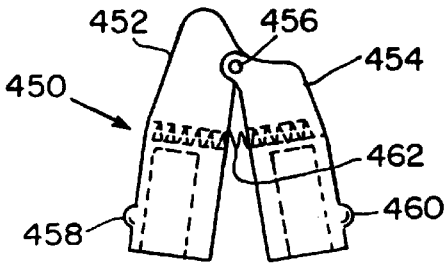
FIG. 58 is a view similar to FIG. 57 with the follower in the open condition whereby the actuators can operate a switching device.

The actuator and follower functions can be provided simultaneously by the same device as shown in FIG. 57, where follower 450 is split into two sections 452 and 454 rotatably connected at hinge 456. Each section 452 and 454 has an actuator detent 458 and 460. Thus when the slots are encountered in a magazine, spring 462 will urge apart sections 452 and 454, as shown in FIG. 58, causing actuator detents 458 and 460 to engage associated contacts.

Figure 59:
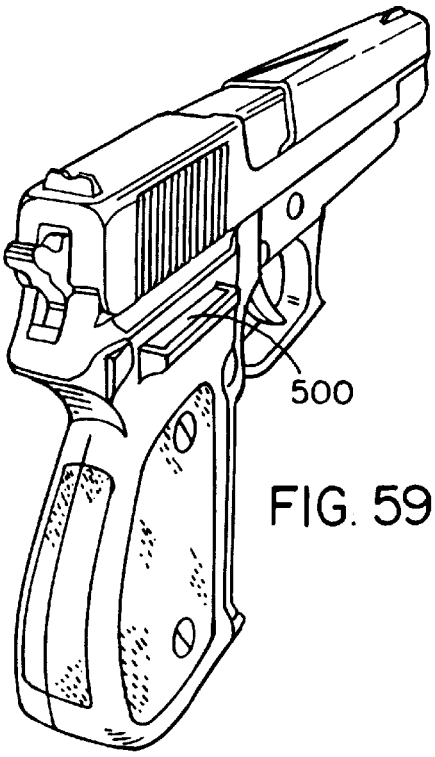
FIG. 59 is a right side perspective view of a firearm showing an alternative mechanical indicator device according to this invention.
Figure 60:
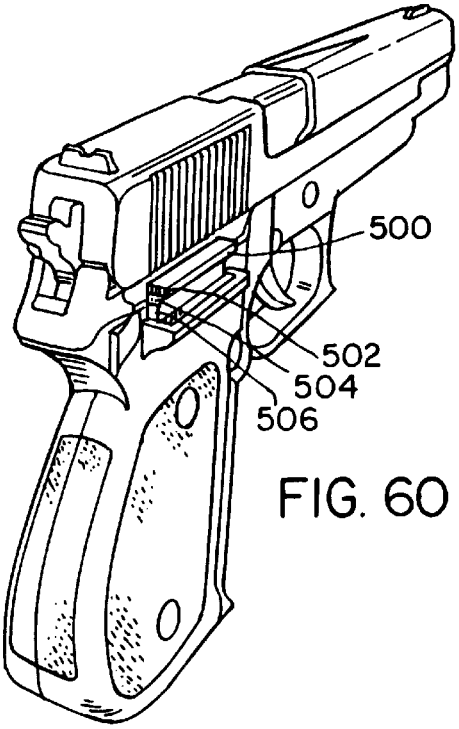
FIG. 60 is a view similar to FIG. 59 with the mechanical indicating device token in the alarm condition.
Figure 61:
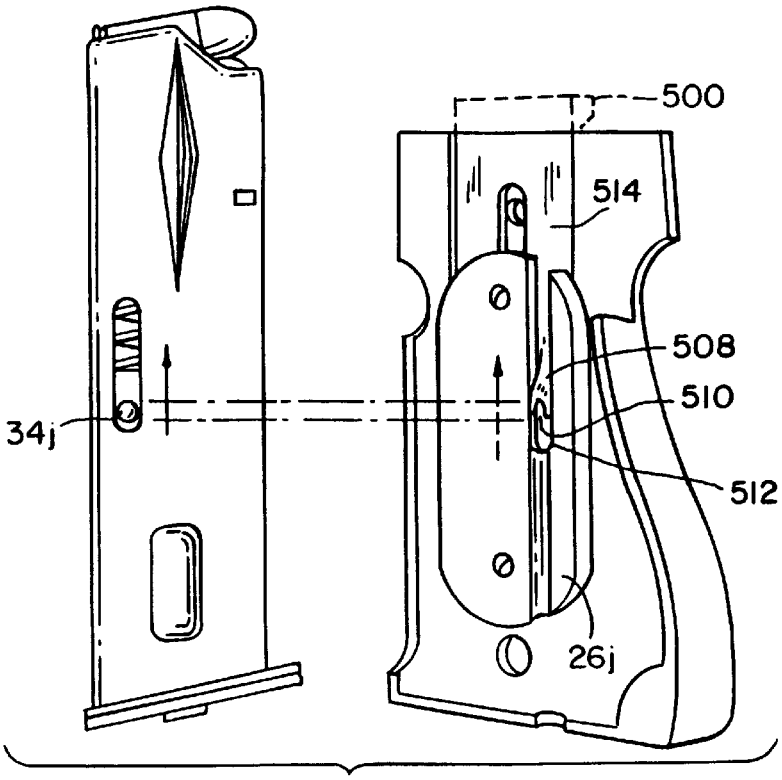
FIG. 61 is an axonometric view of a magazine and actuator and the mechanical monitoring device which operates with the mechanical indicator device of FIGS. 59 and 60.
Figure 62:
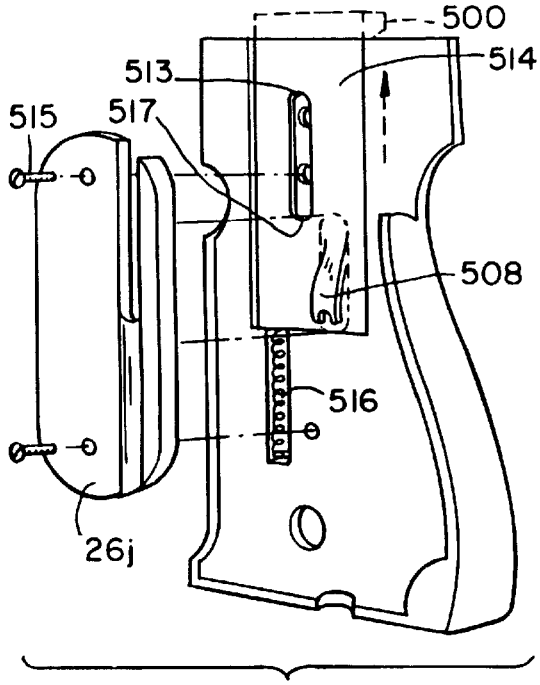
FIG. 62 is an exploded perspective view of the handle grip of FIG. 61 showing in more detail the parts of the mechanical monitoring and display device according to this invention.

Although thus far the automatic monitoring and indicator system according to this invention has been shown implemented electrically, this is not a necessary limitation of the invention. The indicator device may be a mechanical token 500, FIG. 59, which may begin to rise up in steps as the predetermined level of cartridges is reached. For example, the end of token 500, FIG. 60, could be a single color to indicate when no more cartridges are left, or it could be sectioned in three colors 502, 504, 506, which become visible selectively, serially as the cartridges are expended. Such a device in a typical actuator 34*j*, FIG. 61, would engage with a tongue 508, FIG. 61, which contains a groove 510 for receiving actuator 34*j*. Actuator 34*j* then lifts tongue 508. Tongue 508 moves up and down in slot 512 of plate 26*j*. Tongue 508 is a part of slider 514 at the top end of which is carried token 500. A return spring 516, FIG. 62, ensures that slider 514 and token 500 return to their retracted position when the magazine is withdrawn. Tongue 508 also allows the magazine to easily slide by for insertion and release. There is also a recess or slot 513 to accept slider 514. Screw 515 acts as a stop by engaging the lower end 517 of slot 513. Also tongue 508 can fall into the magazine to engage a slot or lifting element, not shown, to be driven upwards.

Figure 65:
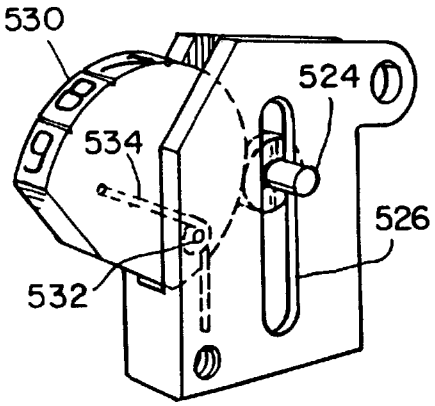
FIG. 65 is a view of the monitoring and indicator system of FIG. 64 in an alarm condition.
Figure 64:
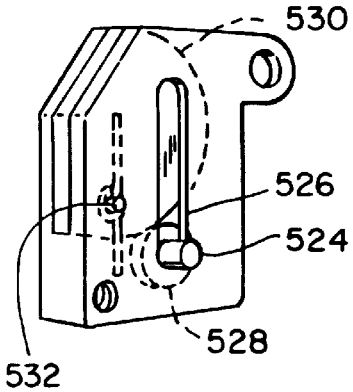
FIG. 64 is a three-dimensional view of the monitoring and indicator system of FIG. 63.
Figure 63:
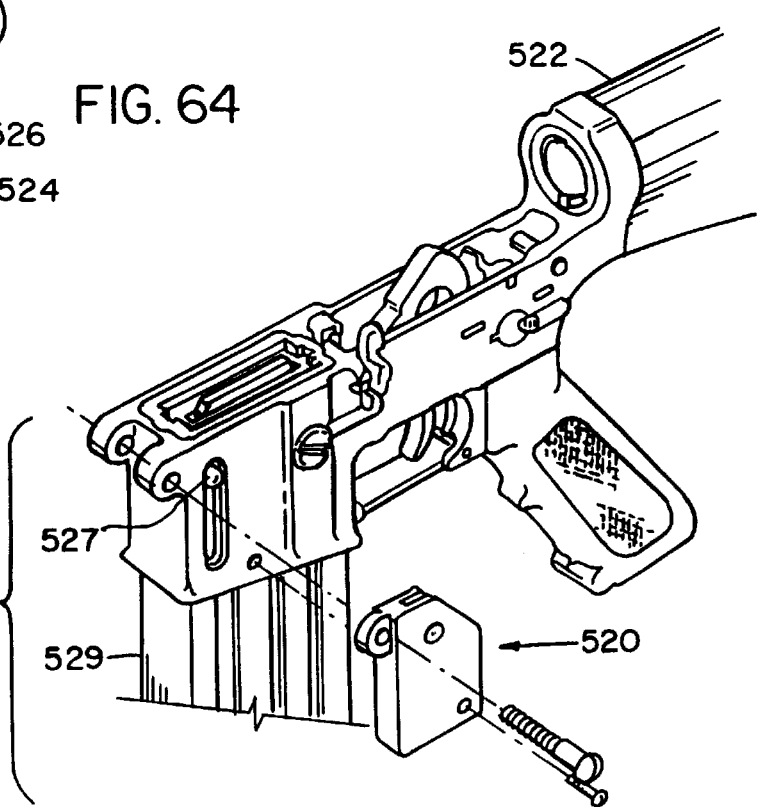
FIG. 63 is a left side perspective view of a rifle employing another form of mechanical monitoring and indicator system according to this invention.

Another mechanical implementation of the monitoring and indicator system 520 according to this invention is shown in FIG. 63 mounted to a rifle 522. System 520 includes slider 524, FIG. 64, mounted through slot 526. Slider 524 has an enlarged flange 528 which bears on token 530 rotatably mounted for rotation about pivot 532. As slider 524 is driven upwardly, FIG. 65, in slot 526 by actuator 527 of magazine 529, FIG. 63, it causes token 530 to rotate outwardly displaying numbers which indicate the number of cartridges spent or remaining. The return spring 534 returns token 530 and slider 524 to the start position when the magazine is removed from the magazine receiver in rifle 522.

Figure 66:
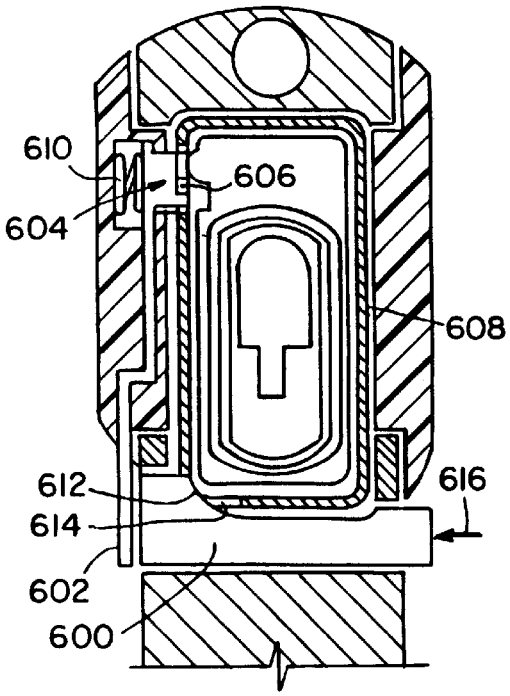
FIG. 66 is a top sectional view of a retractor mechanism for a switching device operable in conjunction with the magazine release.
Figure 67:
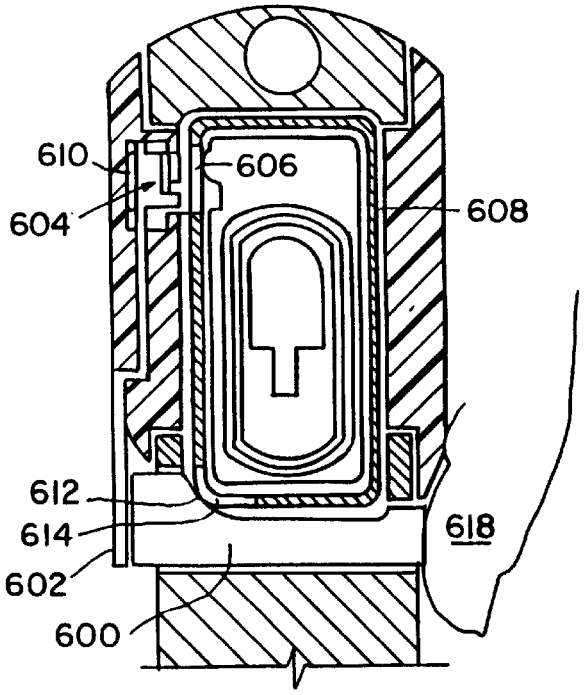
FIG. 67 is a view similar to FIG. 66 with the switching device retracted by operation of the magazine release.

A combination magazine release and switching device retractor is shown in FIG. 66, where magazine release 600 contacts switch extension 602 of switching device 604 urged outwardly through hole 606 in magazine 608 by spring 610. When the magazine 608 is locked in the magazine chamber, a shoulder 612 of release 600 is nested in opening 614 in the comer of magazine 608. However, when release 600 is pushed in the direction of arrow 616 by finger 618, FIG. 67, release 600 not only removes shoulder 612 from opening 614, thereby releasing magazine 608, it also drives switch extension 602 to the left, compressing spring 610 and withdrawing switching device 604 from access hole 606, thereby permitting the magazine to free-fall quickly and easily.

Although thus far the monitoring and indicator system according to this invention has been illustrated as adapted for retrofitting to existing firearms, this is not a necessary limitation of the invention: it can be even more easily adapted to original equipment designed to accept it initially as in FIG. 68, where for example the battery has been shown housed within the frame of the firearm, typically within the handle grips. In one variation the battery may be placed in a housing 700, interconnected by cable 702 to housing 704 which contains both the indicator device and monitoring device.

This invention is also adaptable to any tubular type magazine firearm, as they too have a spring for driving a follower to feed cartridges into a chamber. Firearm 750, FIG. 69, is depicted as a shotgun containing a tubular magazine 752, however, it could be any type of firearm containing a tubular magazine. Actuator 754 is affixed to follower mechanism 756 which is fully compressed and tubular magazine 752 contains five cartridges. There is one additional cartridge within firing chamber 758. Since the switch elements which actuator 754 would engage are not visible in this view, a representation of the actual switch elements is indicated at 760. When firearm 750 is fully loaded actuator 754 is aligned with the sixth switch element indicating that there are six cartridges within firearm 750, five in tubular magazine 752 and one in firing chamber 758. As the cartridges are fired from firearm 750, follower mechanism 756 feeds cartridges from magazine 752 into firing chamber 758. The movement of the follower mechanism 756 causes actuator 754 to engage each switch consecutively so that it keeps an accurate count of the total number of cartridges in firearm 750 at all times, including the cartridges in magazine 752 and in firing chamber 758. When follower mechanism 756 has reached its limit and there are no cartridges remaining in tubular magazine 752, actuator 754 is aligned with the first switch element indicating there is a single cartridge remaining in firearm 750 and that a cartridge is in firing chamber 758.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. An automatic cartridge monitoring and indicator system for a firearm having a magazine and a chamber for monitoring the level of a predetermined number of cartridges in the firearm, comprising:

a magazine for storing a number of cartridges;

a follower mechanism for feeding the cartridges from the magazine into the chamber;

a monitoring device responsive to said follower mechanism;

said monitoring device including a number of magazine switch elements corresponding to the predetermined number of cartridges to be monitored, one of said magazine switch elements corresponding to a cartridge in the chamber, the remainder of said magazine switch elements corresponding to cartridges in the magazine; said switch elements operable by said follower mechanism to monitor the level of cartridges in the magazine and chamber; and an indicator device, responsive to said monitoring device, for providing a representation of the level of cartridges remaining in the firearm.

2. The automatic cartridge monitoring and indicator system of claim 1 in which said switch elements are integral with the firearm.

3. The automatic cartridge monitoring and indicator system of claim 1 further including an actuator movable with said follower mechanism in which said actuator protrudes through an aperture from said magazine to engage said switch elements.

4. The automatic cartridge monitoring and indicator system of claim 1 further including an actuator movable with said follower mechanism in which said magazine includes an aperture and said switch elements protrude into said magazine to engage said actuator.

5. The automatic cartridge monitoring and indicator system of claim 1 in which said indicator device provides a representation of the total number of cartridges remaining in said magazine and chamber of the firearm.

6. The automatic cartridge monitoring and indicator system of claim 1 in which said indicator device provides a representation that the last cartridge is in the chamber and the magazine is empty.

7. The automatic cartridge monitoring and indicator system of claim 1 in which the representation provided by said indicator device includes a visual display.

8. The automatic cartridge monitoring and indicator system of claim 7 in which said visual display includes at least a first light.

9. The automatic cartridge monitoring and indicator system of claim 8 in which said visual display includes an alphanumeric readout.

10. The automatic cartridge monitoring and indicator system of claim 8 in which said light is energized when there is but one cartridge remaining in the chamber of the firearm.

11. The automatic cartridge monitoring and indicator system of claim 8 in which said visual display includes first and second lights, the first of which is energized when there is one cartridge left in the chamber of the firearm and the second of which is energized where there is one cartridge in the chamber and one cartridge left in the magazine.

12. The automatic cartridge monitoring and indicator system of claim 11 in which said first light is red and said second light is yellow.

13. The automatic cartridge monitoring and indicator system of claim 8 in which said visual display includes first, second and third lights, the first of which is energized when there is one cartridge left in the chamber of the firearm, the second of which is energized where there is one cartridge in the chamber and one cartridge left in the magazine, and the third of which is energized when there is one cartridge in the chamber and two cartridges left in the magazine.

14. The automatic cartridge monitoring and indicator system of claim 13 in which said first light is red, said second light is yellow, and said third light is green.

15. The automatic cartridge monitoring and indicator system of claims 8, 11 or 13 in which said first light remains energized after the last cartridge has been fired.

16. The automatic cartridge monitoring and indicator system of claim 8 in which said at least one light includes an LED.

17. The automatic cartridge monitoring and indicator system of claim 1 in which said follower mechanism includes a follower element and a spring device for urging said follower element to feed the cartridges to said firearm.

18. The automatic cartridge monitoring and indicator system of claim 17 further including an actuator movable with said follower mechanism in which said actuator is mounted for movement with said follower element.

19. The automatic cartridge monitoring and indicator system of claim 1 in which said monitoring device includes a power source.

20. The automatic cartridge monitoring and indicator system of claim 1 in which said indicator device is mounted on the firearm.

21. The automatic cartridge monitoring and indicator system of claim 1 in which said switch elements include membrane switches.

22. The automatic cartridge monitoring and indicator system of claim 1 further including an actuator movable with said follower mechanism in which said actuator has an actuator element extending from each side of said magazine.

23. The automatic cartridge monitoring and indicator system of claim 22 in which said monitoring device includes switch elements associated with each side of said magazine for operation by an associated one of said actuator elements.

24. The automatic cartridge monitoring and indicator system of claim 1 further including an actuator movable with said follower mechanism in which each switch element includes a pair of spaced conductors and said actuator includes a conductive contact for bridging said spaced conductors and electrically connecting them to actuate said indicator device.

25. The automatic cartridge monitoring and indicator system of claim 1 further including a remote data connector responsive to said monitoring device for providing a representation of the condition of the firearm to a remote device.

26. The automatic cartridge monitoring and indicator system of claim 1 in which said follower mechanism includes a follower element and an intermediate element spaced from said follower element, a first spring device between said elements and a second spring device engaged with the side of said follower element facing said intermediate element.

27. The automatic cartridge monitoring and indicator system of claim 1 in which the firearm is a pistol.

28. The automatic cartridge monitoring and indicator system of claim 1 in which the magazine is mounted in a magazine receiver and the switch elements are mounted on the outside of the receiver through an aperture.

29. The automatic cartridge monitoring and indicator system of claim 1 in which the firearm is a rifle.

30. The automatic cartridge monitoring and indicator system of claim 1 in which said predetermined number equals one.

31. The automatic cartridge monitoring and indicator system of claim 1 in which said predetermined number equals three.

32. The automatic cartridge monitoring and indicator system of claim 1 in which said predetermined number equals the capacity of the magazine.

33. The automatic cartridge monitoring and indicator system of claim 1 in which said predetermined number equals the capacity of the magazine plus one.

* * * * *

UNITED STATES PATENT AND TRADEMARK OFFICE

CERTIFICATE OF CORRECTION

PATENT NO. : 6,094,850
DATED : August 1, 2000
INVENTOR(S) : Villani

It is certified that error appears in the above-identified patent and that said Letters Patent is hereby corrected as shown below:

Add the Drawing Sheet, consisting of Figure 69, as shown on the attached page.

Signed and Sealed this

Thirteenth Day of November, 2001

*Attest:*

Nicholas P. Godici

NICHOLAS P. GODICI

*Attesting Officer*

*Acting Director of the United States Patent and Trademark Office*